US011305302B2

(12) United States Patent
Dunnu et al.

(10) Patent No.: US 11,305,302 B2
(45) Date of Patent: Apr. 19, 2022

(54) NOZZLE ASSEMBLY FOR A SOLID FUEL BURNER AND METHOD OF OPERATING A NOZZLE ASSEMBLY FOR A SOLID FUEL BURNER

(71) Applicant: GENERAL ELECTRIC COMPANY, Schenectady, NY (US)

(72) Inventors: Gregory Dunnu, Nuertingen (DE); Reinhard Gollnick, Weissach im Tal (DE); Wadim Pimenov, Ostfildern (DE); Jakob Heimann, Stuttgart (DE)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 106 days.

(21) Appl. No.: 16/749,407

(22) Filed: Jan. 22, 2020

(65) Prior Publication Data

US 2021/0220848 A1 Jul. 22, 2021

(51) Int. Cl.
*B05B 1/28* (2006.01)
*F23D 1/00* (2006.01)

(52) U.S. Cl.
CPC ..... *B05B 1/28* (2013.01); *F23D 1/00* (2013.01); *F23D 2201/10* (2013.01); *F23D 2201/20* (2013.01)

(58) Field of Classification Search
CPC . F02K 1/12; F23D 14/22; F23D 14/48; F23D 14/58; F23D 14/105; F23D 14/32; F23D 14/60; F23D 14/70; F23D 14/14; F23D 23/00; F23D 14/26; F23D 14/36; F23D 14/62; F23D 11/38; F23D 14/06; F23D 14/28; F23D 14/46; F23D 14/56; F23D 17/00; F23D 17/002; F23D 17/005; F23D 2213/00; F23D 2900/00015; F23D 2900/14481; F23D 91/02; F23D 11/406; F23D 11/443; F23D 14/02; F23D 14/08; F23D 14/20; F23D 14/72; F23D 2900/00017; F23D 2900/11402; F23D 9/00; F23D 11/00; F23D 11/10; F23D 11/345; F23D 11/408; F23D 11/44; F23D 14/00;

(Continued)

(56) References Cited

U.S. PATENT DOCUMENTS 1,837,358 A * 12/1931 Danks ..... F23D 14/00 110/104 B
2,895,435 A * 7/1959 Bogot ..... F23D 1/00 239/587.4
2004/0221777 A1* 11/2004 Hart ..... F23D 1/00 110/213

FOREIGN PATENT DOCUMENTS

CN 204176641 2/2015
CN 104132330 B 2/2017

(Continued)

OTHER PUBLICATIONS

English Translation for Chen (CN204176641U).*
International Search Report from corresponding foreign patent application No. PCT/US2021/013380 dated Apr. 19, 2021.

*Primary Examiner* — Jason Lau
(74) *Attorney, Agent, or Firm* — Grogan, Tuccillo & Vanderleeden, LLP

(57) ABSTRACT

A nozzle tip for a pulverized solid fuel pipe nozzle of a pulverized solid fuel-fired furnace is provided. The nozzle tip includes a primary shroud having an inlet end and an outlet end, and an outlet at the outlet end for the passage of a pulverized solid fuel into the furnace. An area of the outlet is selectively adjustable to vary an exit velocity of the pulverized solid fuel from the nozzle tip.

15 Claims, 21 Drawing Sheets

(58) Field of Classification Search
CPC ..... F23D 14/085; F23D 14/24; F23D 14/30; F23D 14/34; F23D 14/38; F23D 14/52; F23D 14/586; F23D 14/84; F23D 2203/007; F23D 2203/106; F23D 2208/10; F23D 2214/00; F23D 2900/00008; F23D 2900/00013; F23D 2900/11101; F23D 2900/14003; F23D 2900/14021; F23D 2900/14062; F23D 2900/14125; F23D 2900/14641; F23D 2900/21; F23D 3/16; F23D 99/00; F23D 11/001; F23D 11/102; F23D 11/106; F23D 11/107; F23D 11/108; F23D 11/24; F23D 11/30; F23D 11/32; F23D 11/404; F23D 11/446; F23D 11/46; F23D 14/04; F23D 14/125; F23D 14/145; F23D 14/465; F23D 14/66; F23D 14/76; F23D 14/82; F23D 14/825; F23D 2204/00; F23D 2700/001; F23D 2900/00014; F23D 2900/11401; F23D 2900/11403; F23D 2900/14004; F23D 2900/14042; F23D 2900/14063; F23D 2900/21001; F23D 3/18; F23D 3/24; F23D 5/04; F23D 91/04
See application file for complete search history.

(56) References Cited

FOREIGN PATENT DOCUMENTS

| | | | |
|---|---|---|---|
| DE | 69427993 | T2 | 4/2002 |
| EP | 0113342 | B1 | 7/1984 |
| EP | 3279563 | A1 | 2/2018 |
| KR | 20180035518 | A | 4/2018 |
| WO | 2009114331 | A2 | 9/2009 |

* cited by examiner

NOZZLE ASSEMBLY FOR A SOLID FUEL BURNER AND METHOD OF OPERATING A NOZZLE ASSEMBLY FOR A SOLID FUEL BURNER

BACKGROUND

Technical Field

Embodiments of the invention relate generally to firing systems for use with pulverized solid fuel burners, and more specifically, to an adjustable nozzle assembly for use in such firing systems.

Discussion of Art

Systems for delivering pulverized solid fuel (e.g., coal) to steam generators typically include a plurality of nozzle assemblies through which the pulverized coal is delivered, using air, into a combustion chamber of the steam generator. The nozzle assemblies are typically disposed within windboxes, which may be located proximate to the corners of the steam generator. Each nozzle assembly includes a nozzle tip, which protrudes into the combustion chamber. Each nozzle tip delivers a single stream, or jet, of the pulverized coal and air into the combustion chamber. After leaving the nozzle tip, the single pulverized coal/air jet disperses in the combustion chamber.

Typically, the nozzle tips are arranged to tilt up and down to adjust the location of the flame within the combustion chamber. The flames produced at each pulverized solid fuel nozzle are stabilized through global heat- and mass-transfer processes. Thus, a single rotating flame envelope (e.g., a "fireball"), centrally located in the furnace, provides gradual but thorough and uniform pulverized solid fuel-air mixing throughout the entire furnace.

Although the pulverized solid fuel nozzle tips of the prior art are operative for their intended purposes, there has nevertheless been evidenced in the prior art a need for such pulverized solid fuel nozzle tips to be further improved, specifically in the pursuit of greater flexibility in terms of the ranks of coal that may be burned. In particular, typical nozzle tips are configured such that, while they can be angled up or down, the outlet area of the nozzle tips is not variable. This inability to vary the nozzle tip outlet area means that the exit velocity of the pulverized coal likewise cannot be varied, which limits the range of coal types that can be burned. This is because different coal ranks, with different volatile matter content, require different exit velocities for pulverized coal to achieve optimal combustion results (i.e., high fuel conversion efficiency and lox NOx emission). In particular, as a design rule, burners for low rank coals are designed with a lower pulverized coal exit velocity thank for high rank coals, and vice versa. As such the nozzle tips of each burner are designed to provide an exit velocity specifically tailored to a particular coal rank and volatile matter content. Coal rank that differ from a design coal therefore cannot be burned without time consuming and costly retrofit to provide the nozzle tips with an outlet area that corresponds to the desired exit velocity of the pulverized coal.

In view of the above, there is a need for a pulverized coal nozzle tip having a variable or adjustable outlet area, which allows for the exit velocity of the pulverized coal to be adjusted in dependence upon the rank of coal being burned.

BRIEF DESCRIPTION

In an embodiment, a nozzle tip for a pulverized solid fuel pipe nozzle of a pulverized solid fuel-fired furnace is provided. The nozzle tip includes a primary shroud having an inlet end and an outlet end, and an outlet at the outlet end for the passage of a pulverized solid fuel into the furnace. An area of the outlet is selectively adjustable to vary an exit velocity of the pulverized solid fuel from the nozzle tip.

In another embodiment, a method of operating a burner is provided. The method includes the steps of suppling a flow of fuel through at least one fuel nozzle assembly having a nozzle tip to a combustion chamber, and varying an exit velocity of the fuel from the nozzle tip in dependence upon at least one of a property of the fuel and/or an operational requirement of the burner.

In yet another embodiment, a combustion system is provided. The combustion system includes a combustion chamber, and a nozzle tip of a nozzle assembly configured to direct a mixed flow of fuel and primary air into the combustion chamber, the nozzle tip including a primary shroud having an outlet. An area of the outlet is selectively adjustable to vary an exit velocity of the mixed flow of fuel and primary air from the nozzle tip.

DRAWINGS

The present invention will be better understood from reading the following description of non-limiting embodiments, with reference to the attached drawings, wherein below:

DETAILED DESCRIPTION

Figure 1:
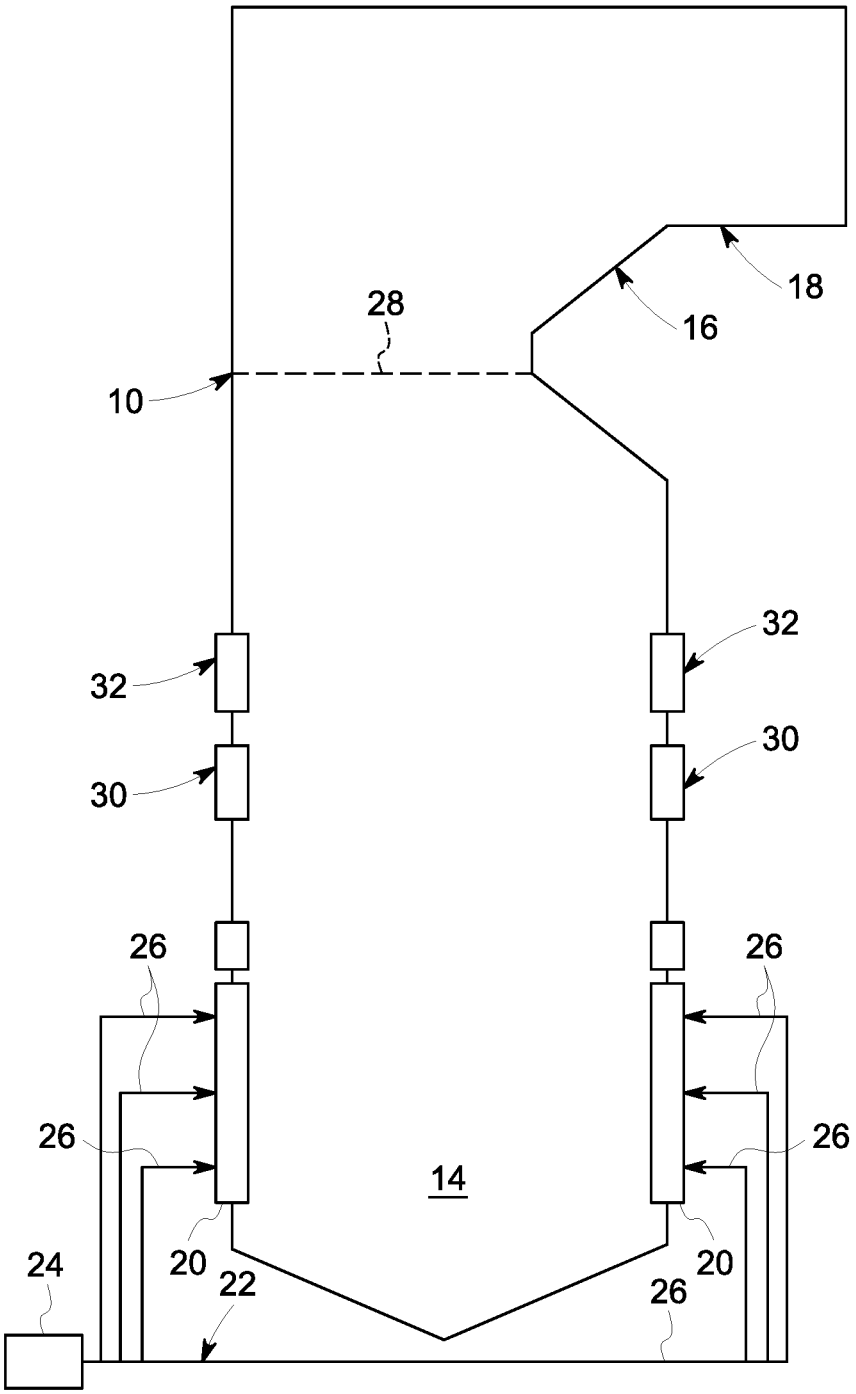
FIG. 1 is a diagrammatic representation of a vertical sectional view of a pulverized solid fuel-fired furnace embodying a firing system with which a solid fuel nozzle tip construction in accordance with the invention may be utilized.

Reference will be made below in detail to exemplary embodiments of the invention, examples of which are illustrated in the accompanying drawings. Wherever possible, the same reference characters used throughout the drawings refer to the same or like parts. While embodiments of the invention are directed to a nozzle tip for a solid fuel-fired furnace, embodiments of the invention may also be used to control the velocity of fuel in any state (i.e., solid, liquid or gas).

Referring now to the drawing, and more particularly to FIG. 1 thereof, there is depicted therein a pulverized solid fuel-fired furnace, generally designated by reference numeral 10. Inasmuch as the nature of the construction and the mode of operation of pulverized solid fuel-fired furnaces known to those skilled in the art, it is not deemed necessary, therefore, to set forth herein a detailed description of the pulverized solid fuel-fired furnace 10 illustrated in FIG. 1. Rather, for purposes of obtaining an understanding of a pulverized solid fuel-fired furnace 10 in the firing system of which a solid fuel nozzle tip constructed in accordance with the invention is suited for employment, it is deemed to be sufficient that there be presented herein merely a description of the nature of the components of the pulverized solid fuel-fired furnace 10 and of the components of the firing system with which the pulverized solid fuel-fired furnace 10 is suitably provided and with which the solid fuel nozzle tip cooperates.

Referring further to FIG. 1, the pulverized solid fuel-fired furnace 10 includes a burner region 14. It is within the burner region 14 of the pulverized solid fuel-fired furnace 10 that, in a manner known to those skilled in this art, combustion of the pulverized solid fuel and air is initiated. The hot gases that are produced from combustion of the pulverized solid fuel and air rise upwardly in the pulverized solid fuel-fired furnace 10. During the upwardly movement thereof in the pulverized solid fuel-fired furnace 10, the hot gases give up heat to the fluid passing through the tubes (not shown) that in conventional fashion line all four of the walls of the pulverized solid fuel-fired furnace 10. Then, the hot gases exit the pulverized solid fuel-fired furnace 10 through the horizontal pass 16, which in turn leads to the rear gas pass 18. Both the horizontal pass 16 and the rear gas pass 18 commonly contain other heat exchanger surface (not shown) for generating and superheating steam, in a manner known to those skilled in the art. Thereafter, the steam commonly is made to flow to a turbine (not shown), which forms one component of a turbine/generator set (not shown), such that the steam provides the motive power to drive the turbine (not shown) and thereby also the generator (not shown), which in known fashion is cooperatively associated with the turbine, such that electricity is thus produced from the generator (not shown).

With the preceding by way of background, reference is once again had to FIG. 1 for purposes of setting forth herein a description of the nature of the construction and the mode of operation of the firing system with which the pulverized solid fuel-fired furnace 10 is suitably provided. The subject firing system as seen with reference to FIG. 1 includes a housing in the form of a main windbox 20 that is provided with a plurality of air compartments (not shown) through which air supplied from a suitable source thereof (not shown) is injected into the burner region 14 of the pulverized solid fuel-fired furnace 10. In addition, the windbox 20 is provided with a plurality of fuel compartments (not shown) through which solid fuel is injected into the burner region 14. The solid fuel, which is injected through the aforereferenced plurality of fuel compartments (not shown), is supplied to this plurality of fuel compartments (not shown) by means of a pulverized solid fuel supply means, denoted generally by the reference numeral 22 in FIG. 1. To this end, the pulverized solid fuel supply means 22 includes a pulverizer, denoted generally by the reference numeral 24 in FIG. 1, and a plurality of pulverized solid fuel ducts 26. The pulverized solid fuel is transported through the pulverized solid fuel ducts 26 from the pulverizer 24 to which the pulverized solid fuel ducts 26 are connected in fluid flow relation to the previously mentioned plurality of fuel compartments (not shown) to which the pulverized solid fuel ducts 26 are also connected in fluid flow relation. Although not shown in the interest of maintaining clarity of illustration in the drawing, the pulverizer 24 is operatively connected to a fan (not shown), which in turn is operatively connected in fluid flow relation with the previously mentioned plurality of air compartments (not shown), such that air is supplied from the fan (not shown) to not only the aforesaid plurality of air compartments (not shown) but also to the pulverizer 24 whereby the pulverized solid fuel supplied from the pulverizer 24 to the aforesaid plurality of fuel compartments (not shown) is transported through the pulverized solid fuel ducts 26 in an air stream in a manner known in the art.

In further regard to the nature of the firing system, two or more discrete levels of separated overfire air are incorporated in each corner of the pulverized solid fuel-fired furnace 10 so as to be located between the top of the main windbox 20 and the furnace outlet plane 28. To this end, the firing system with which the pulverized solid fuel-fired furnace 10 is suitably provided embodies two or more discrete levels of separated overfire air, i.e., a low level of separated overfire air denoted generally in FIG. 1 of the drawing by the reference numeral 30 and a high level of separated overfire air denoted generally in FIG. 1 of the drawing by the reference numeral 32. The low level 30 of separated overfire air is suitably supported through the use of any conventional form of support means (not shown) suitable for use for such a purpose within the burner region 14 of the pulverized solid fuel-fired furnace 10 so as to be suitably spaced from the top of the windbox 20, and so as to be substantially aligned with the longitudinal axis of the main windbox 20. Similarly, the high level 32 of separated overfire air is suitably supported through the use of any conventional form of support means (not shown) suitable for use for such a purpose within the burner region 14 of the pulverized solid fuel-fired furnace 10 so as to be suitably spaced from the low level 30 of separated overfire air, and so as to be substantially aligned with the longitudinal axis of the main windbox 20. The low level 30 of separated overfire air and the high level 32 of separated overfire air are suitably located between the top of the main windbox 20 and the furnace outlet plane 28 such that it will take the gases generated from the combustion of the pulverized solid fuel a preestablished amount of time to travel from the top of the main windbox 20 to the top of the high level 32 of separated overfire air.

While not illustrated in FIG. 1, pulverized solid fuel nozzles each having a solid fuel nozzle tip are suitably supported in mounted relation within each of the plurality of fuel compartments (not shown) to which reference has been had hereinbefore. The nozzles, and nozzle tips thereof, are mounted so as to direct pulverized solid fuel (e.g., a solid fuel such as coal and biomass, or coal) and air into the burner region 14 of the furnace. As indicated below, according to embodiments of the invention, the nozzle tip of one or more of the nozzles is configured so as to allow for vertical and/or horizontal angular adjustment of the nozzle tip, as well adjustment of the cross-sectional area of the nozzle tip outlet.

Referring now to FIGS. 2-16, a nozzle tip 100 of a solid fuel nozzle for use in a solid fuel burner/furnace (e.g., furnace 10) according to one embodiment of the invention, is shown. As shown therein, the nozzle tip 100 has an inlet end 102 (defining an inlet) and an outlet end 104 (defining an outlet), and includes a secondary shroud 106 and a primary shroud 108 enclosed therein. In an embodiment, the primary shroud 108 and the secondary shroud 106 are mechanically interconnected with one another. In an embodiment, the primary shroud 108 and the secondary shroud 106 are fixedly connected to one another.

As best shown in FIGS. 2-6, the primary shroud 108 includes a top plate 110, a bottom plate 112, and opposed side plates 114, 116 that define a duct 118 for a flow of an entrained fuel (e.g., pulverized coal entrained in primary air) from the inlet end 102 to the outlet end 104. As will be appreciated, the top plate 110, the bottom plate 112, and the opposed side plates 114, 116 of the primary shroud 108, at the outlet end 104, define an outlet area of the nozzle tip 100. The secondary shroud 106, for its part, includes a top plate 120 and a bottom plate 122. The secondary shroud 106 and the primary shroud 108 form therebetween a secondary air duct 124 for the passage of secondary or circumferential air from the inlet end 102 to the outlet end 104. In particular, the secondary air duct 124 generally surrounds the primary shroud 108 and includes spaces formed between the top plate 120 of the secondary shroud 106 and the top plate 110 of the primary shroud 108, and between the bottom plate 122 of the secondary shroud 106 and the bottom plate 112 of the primary shroud 108.

Figure 2:
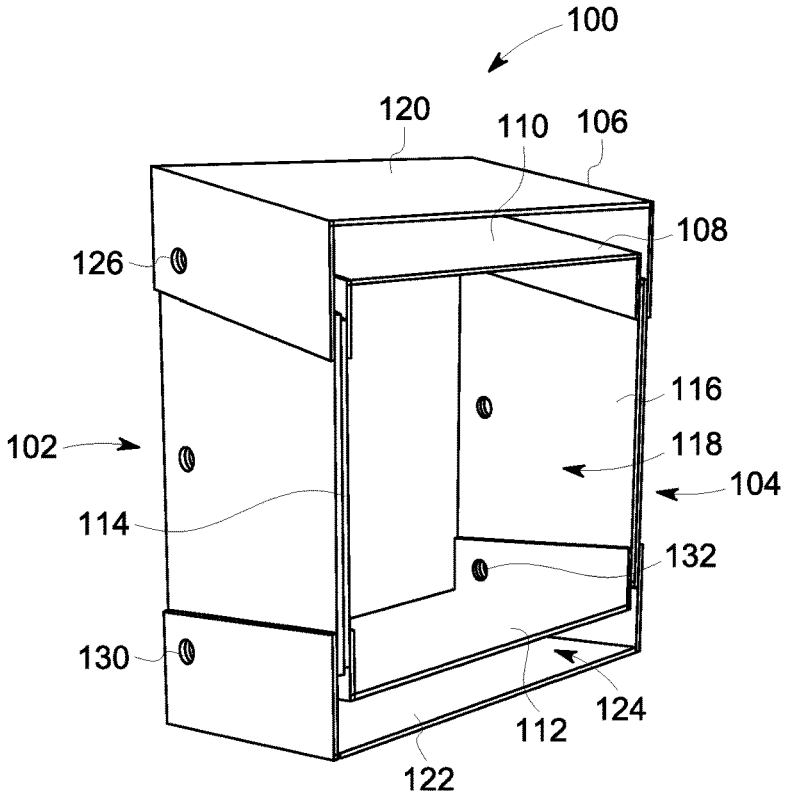
FIG. 2 is an outlet end, perspective view of a solid fuel nozzle tip for use with the pulverized solid fuel-fired furnace of FIG. 1, according to an embodiment of the invention, showing a neutral outlet area position thereof.
Figure 3:
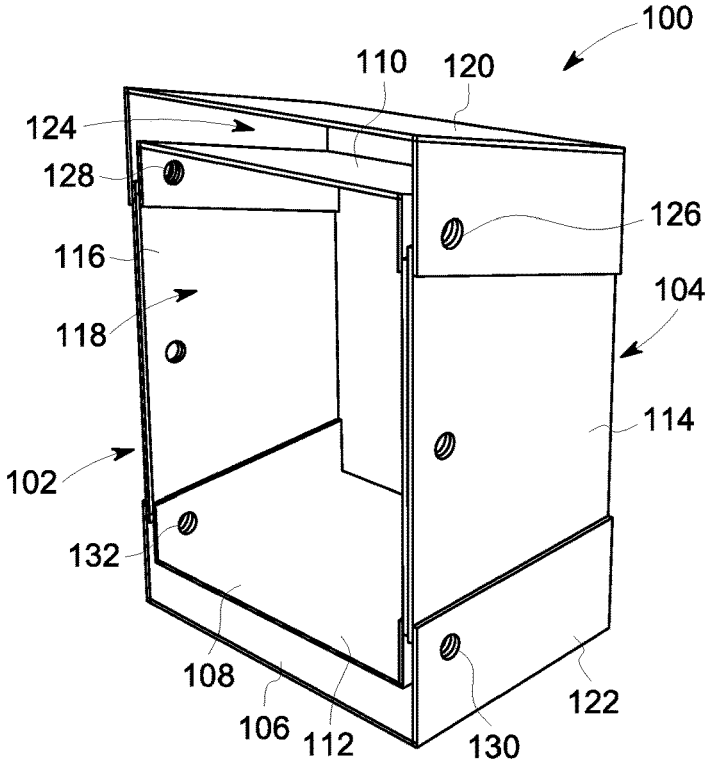
FIG. 3 is an inlet end, perspective view of the solid fuel nozzle tip of FIG. 2, in a neutral outlet area position.
Figure 4:
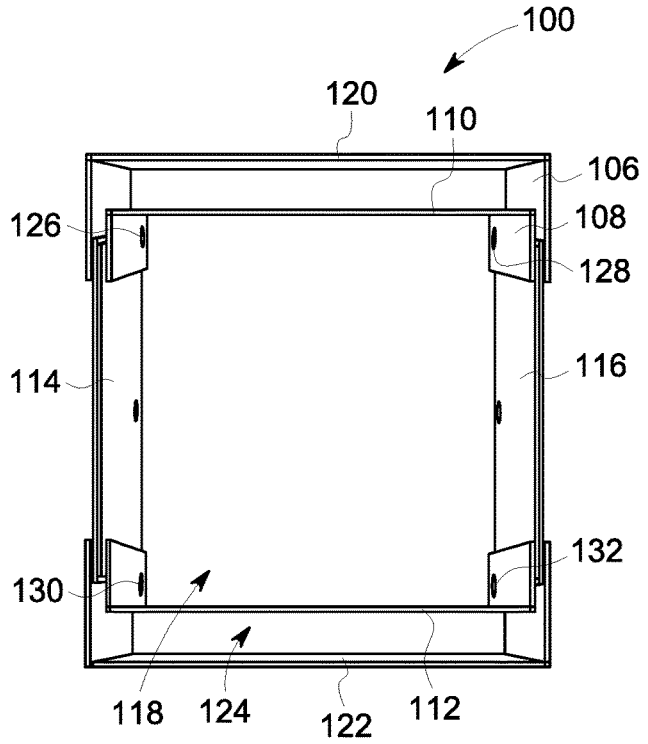
FIG. 4 is a front elevational view of the solid fuel nozzle tip of FIG. 2, in a neutral outlet area position.
Figure 5:
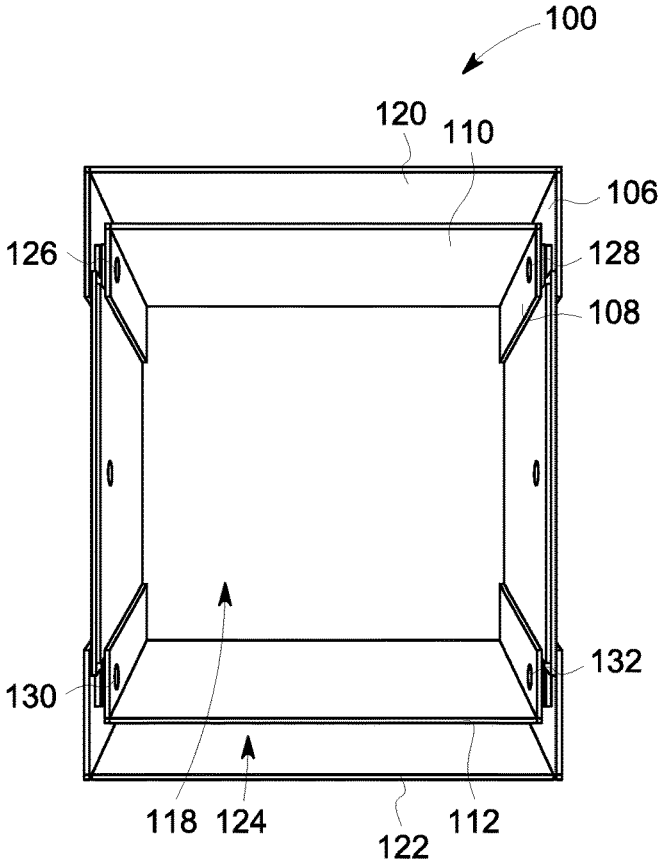
FIG. 5 is a rear elevational view of the solid fuel nozzle tip of FIG. 2, in a neutral outlet area position.

As best illustrated in FIGS. 2 and 3, the top plates 110, 120 of the primary shroud 108 and secondary shroud 106, respectively, are rotatable about an axis extending through pivot points 126, 128 adjacent to the inlet end 102 of the nozzle tip 100, and the bottom plates 112, 122 of the primary shroud 108 and secondary shroud 106, respectively, are rotatable about an axis extending through pivot points 130, 132 adjacent to the inlet end 102 of the nozzle tip 100, for the purposes disclosed hereinafter. In an embodiment, one or more actuators (not shown) may be operatively connected to one or both of the top plates 110, 120 and/or one or both of the bottom plates 112, 122 for effecting rotation of the top plates 110, 120 and/or bottom plates 112, 122 about these axes. In an embodiment, a single actuator may be used to rotate both the top plates 110, 120 and the bottom plates 112, 122. While it has been disclosed that the top plates 110, 120 are rotatable about the axis extending between pivot points 126, 128, and the bottom plates 112, 122 are rotatable about the axis extending between pivot points 130, 132, in some embodiments, only one of the top plates or bottom plates are rotatable (while the other of the top plates or bottom plates are maintained in fixed position).

Figure 6:
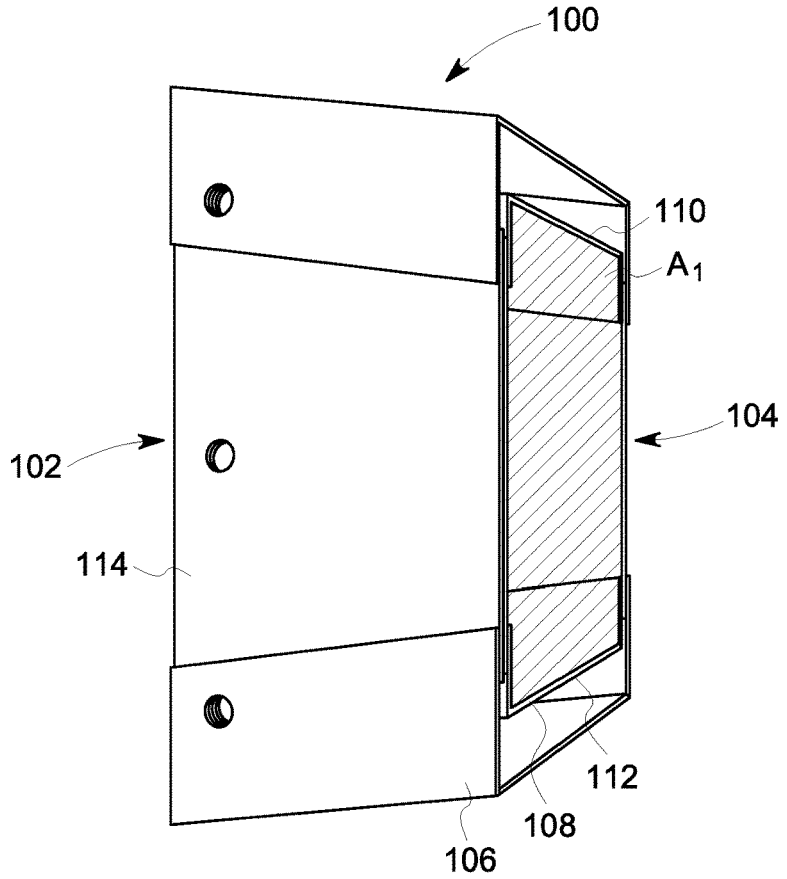
FIG. 6 is another perspective elevational view of the solid fuel nozzle tip of FIG. 2, in a neutral outlet area position.
Figure 7:
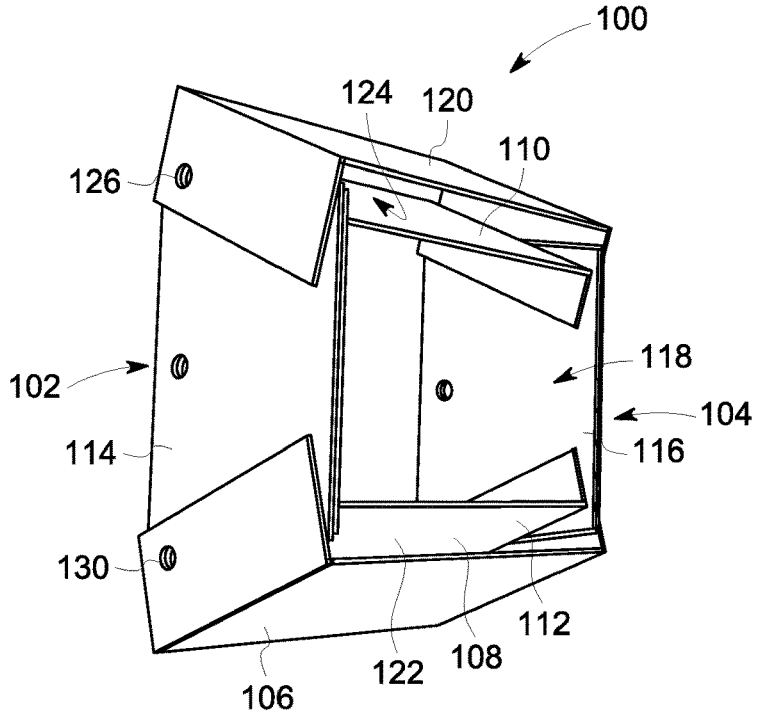
FIG. 7 is an outlet end, perspective view of the solid fuel nozzle tip of FIG. 2, showing a closed outlet area position thereof.
Figure 8:
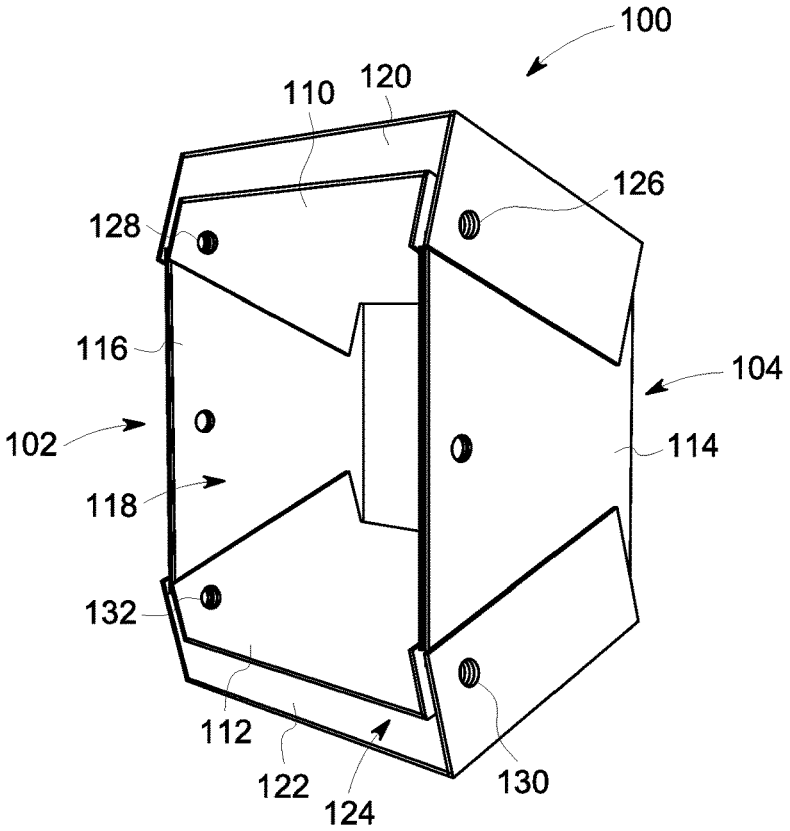
FIG. 8 is an inlet end, perspective view of the solid fuel nozzle tip of FIG. 2, in a closed outlet area position.
Figure 9:
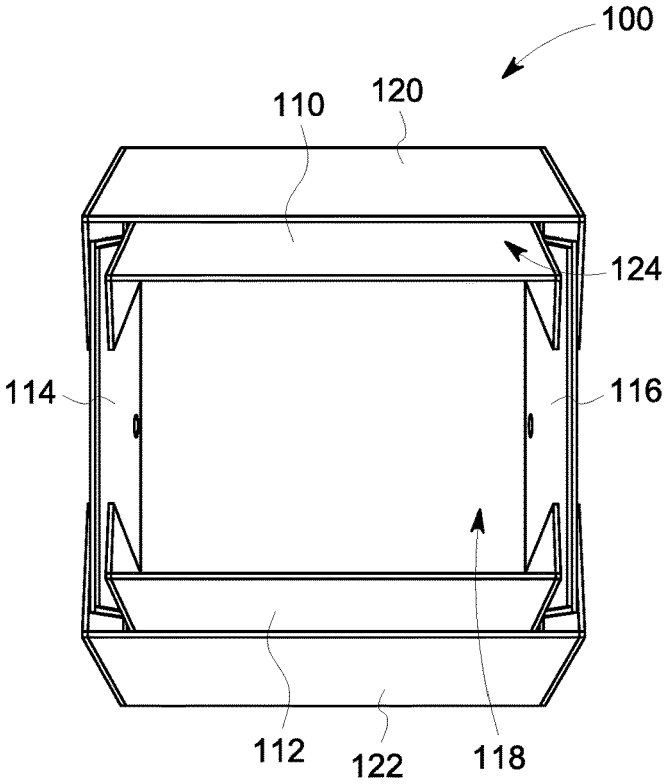
FIG. 9 is a front elevational view of the solid fuel nozzle tip of FIG. 2, in a closed outlet area position.
Figure 10:
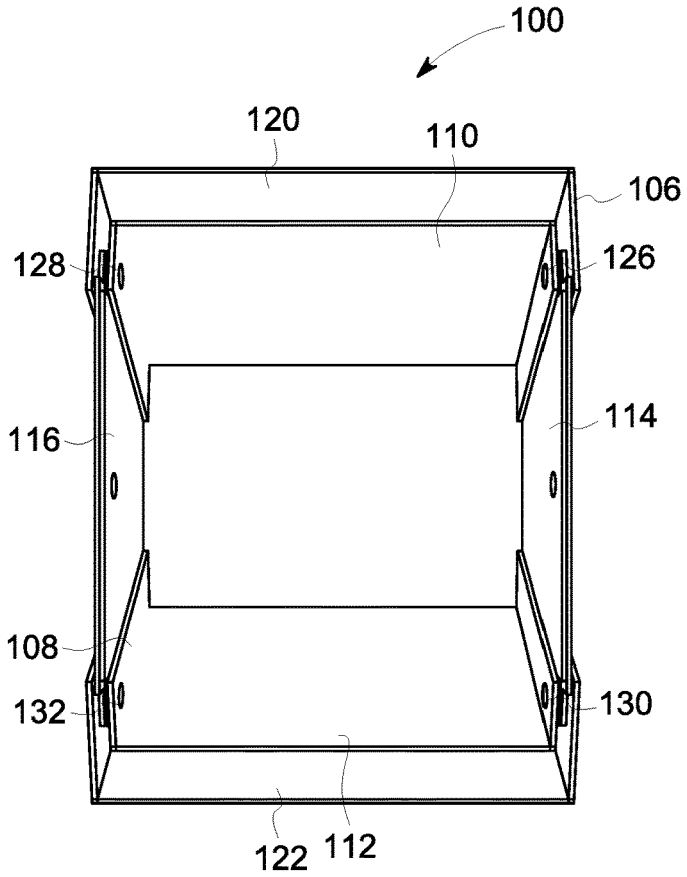
FIG. 10 is a rear elevational view of the solid fuel nozzle tip of FIG. 2, in a closed outlet area position.

As indicated above, and with reference to FIG. 6, the top plate 110, the bottom plate 112, and the opposed side plates 114, 116 of the primary shroud 108, at the outlet end 104, define an outlet area, $A_1$, of the nozzle tip 100. As discussed hereinafter, the outlet area $A_1$ of the nozzle tip 100 may be varied by adjusting or varying the angular orientation of top plates 110, 120 and/or bottom plates 112, 122, by rotating the top plates and/or bottom plates about their respective axes. selectively increase or decrease the area of the outlet.

Figure 11:
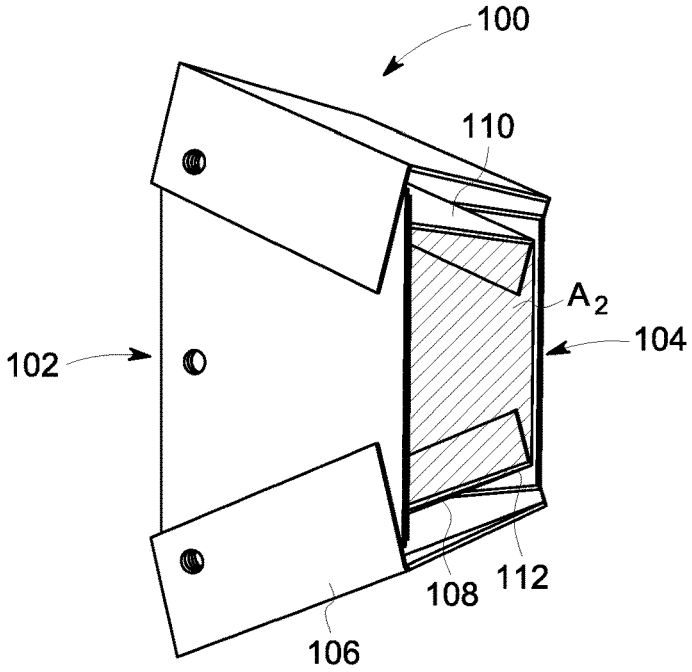
FIG. 11 is another perspective elevational view of the solid fuel nozzle tip of FIG. 2, in an open outlet area position.
Figure 12:
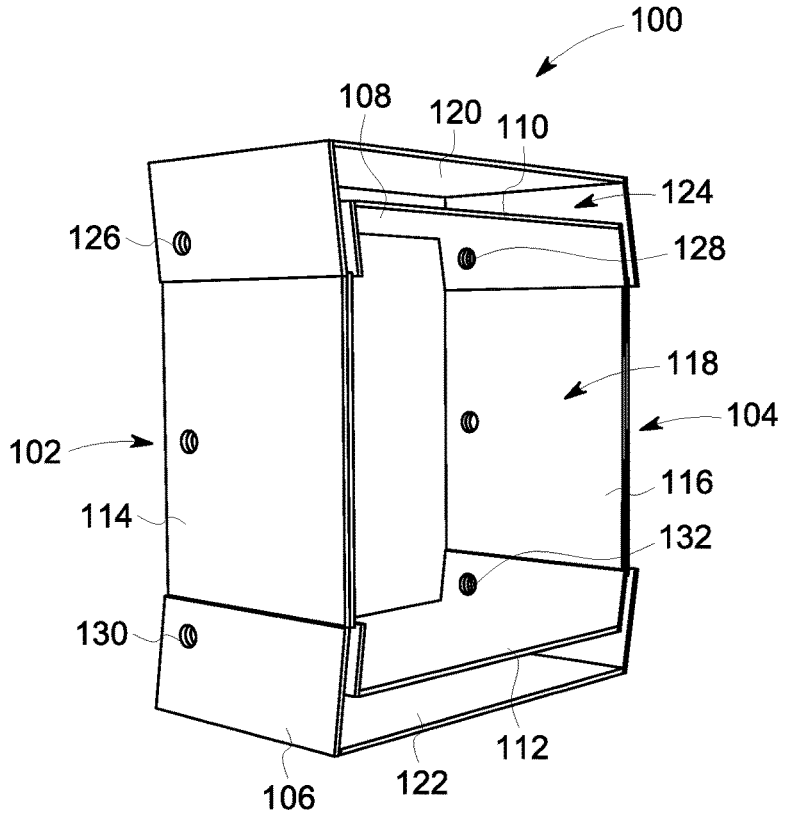
FIG. 12 is an outlet end, perspective view of the solid fuel nozzle tip of FIG. 2, showing an open outlet area position thereof.
Figure 13:
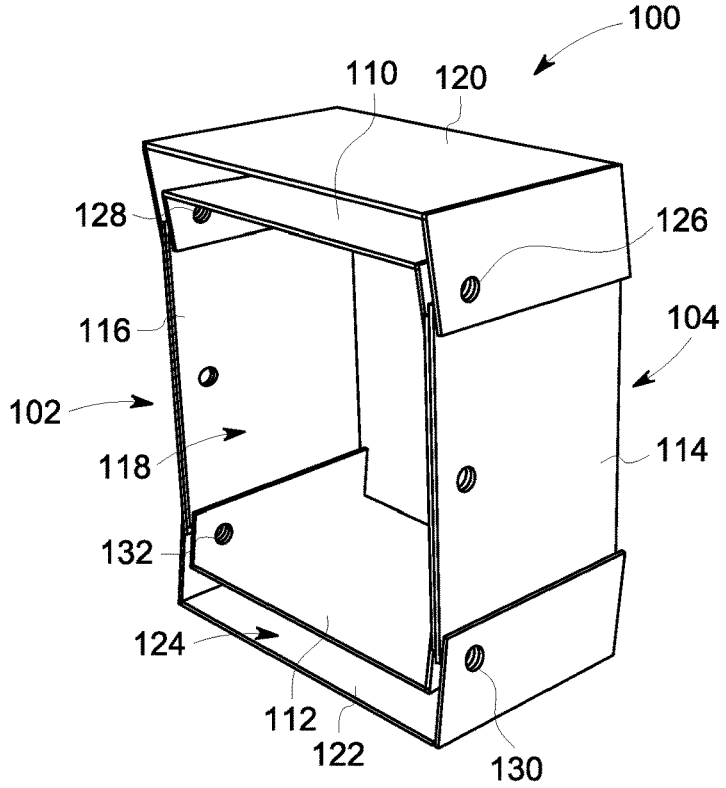
FIG. 13 is an inlet end, perspective view of the solid fuel nozzle tip of FIG. 2, in an open outlet area position.
Figure 14:
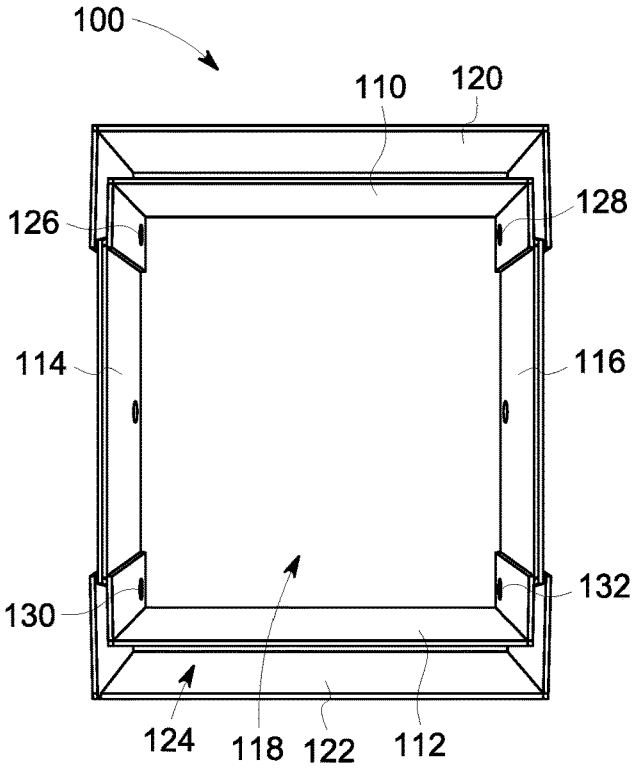
FIG. 14 is a front elevational view of the solid fuel nozzle tip of FIG. 2, in an open outlet area position.
Figure 15:
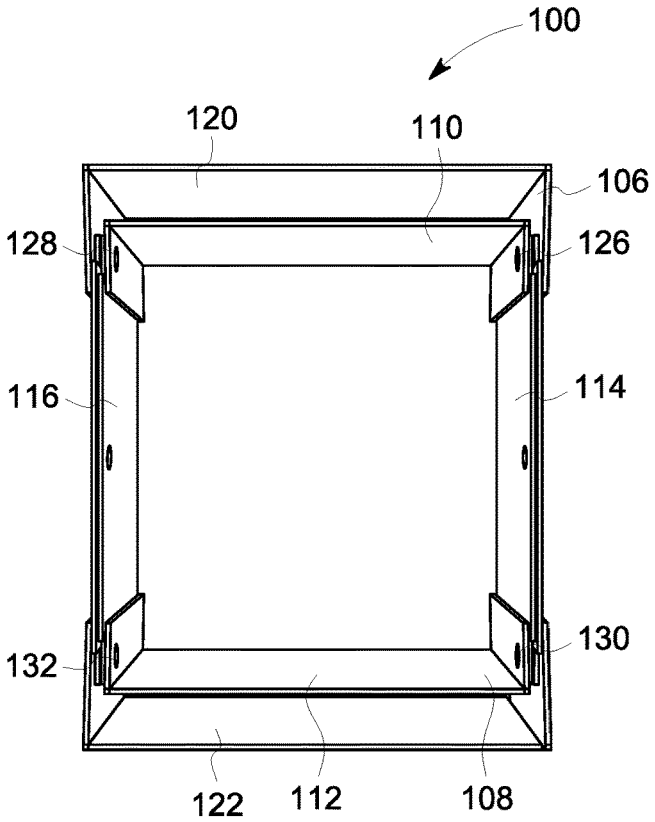
FIG. 15 is a rear elevational view of the solid fuel nozzle tip of FIG. 2, in an open outlet area position.

For example, with specific reference to FIGS. 7-11, both the top plates 110, 120 and bottom plates 112, 122 of the primary shroud 108 and secondary shroud, respectively, may be rotated about the axes extending through points 126, 128 and 130, 132 towards a closed position such that the duct 118 defined by the top and bottom plates 110, 112 of the primary shroud converge towards the outlet end 104 of the nozzle tip 100. As best shown in FIG. 11, in this position, the outlet area, $A_2$, of the nozzle tip 100 is decreased as compared to the outlet area, $A_1$, of the nozzle tip 100 when in its neutral position (FIG. 6).

Figure 16:
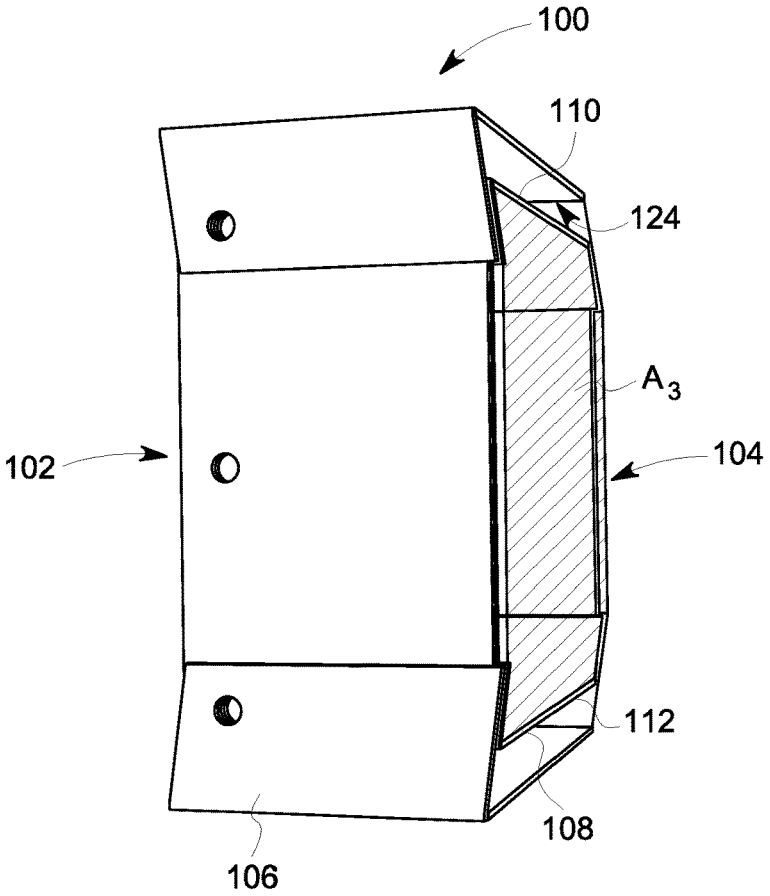
FIG. 16 is another perspective elevational view of the solid fuel nozzle tip of FIG. 2, in an open outlet area position.

Similarly, with specific reference to FIGS. 12-16, both the top plates 110, 120 and bottom plates 112, 122 of the primary shroud 108 and secondary shroud, respectively, may be rotated about the axes extending through points 126, 128 and 130, 132 towards an open position such that the duct 118 defined by the top and bottom plates 110, 112 of the primary shroud diverge towards the outlet end 104 of the nozzle tip 100. As best shown in FIG. 16, in this position, the outlet area, $A_3$, of the nozzle tip 100 is increased as compared to the outlet area, $A_1$, of the nozzle tip 100 when in its neutral position (FIG. 6).

The nozzle tip 100 of the invention is therefore adjustable to vary the cross-sectional area of the nozzle tip outlet. In particular, the top plate 110 and/or bottom plate 112 of the primary shroud 108 (and thus the top plate 120 and bottom plate 122 of the secondary shroud 106 by virtue of their mechanical linkage) can be rotated to bring the forward edges of the top plate 110 and bottom plate 112 closer to one another (to decrease the outlet area of the nozzle tip—FIG. 7-11) or move the forward edges of the top plate 110 and bottom plate 112 further away from one another (to increase the outlet area of the nozzle tip—FIG. 12-16). As will be appreciated, selectively increasing or decreasing the outlet area of the nozzle tip 100 can therefore be utilized to selectively decrease or increase a flow velocity of pulverized fuel passing out of the outlet end 104 of the nozzle tip 100. In particular, decreasing the cross-sectional area of the nozzle tip 100 (FIG. 11) effects a corresponding increase in the velocity of the pulverized fuel passing out of the outlet end of the nozzle tip 100. Similarly, increasing the cross-sectional area of the nozzle tip 100 (FIG. 16) effects a corresponding decrease in the velocity of the pulverized fuel passing out of the outlet end of the nozzle tip 100.

Accordingly, the adjustable nozzle tip 100 of the invention can be utilized to rather easily adjust the velocity of solid fuel exiting the nozzle tip 100 to enable the burning of coal of different rank (having a different volatile matter content), without retrofitting. As a result, the nozzle tip 100 of the invention enables burners to service a wide range of coal types or ranks with a wide range of volatile matter contents to achieve optimal combustion results, simply by selectively adjusting the cross-sectional area of the nozzle tip outlet to set the solid fuel exit velocity to a point that correlates to optimal combustion for the particular coal rank/type utilized. In this respect, the nozzle tip 100 of the invention provides for easy and rapid adjustment of the exit velocity of the pulverized coal in dependence upon the rank of coal being burned. For example, where a lower coal rank is desired to be used, the nozzle tip 100 may be moved towards its open outlet area position (increasing the outlet area) in order to decrease the exit velocity of the pulverized coal to ensure optimal combustion. Similarly, where a high coal rank is desired to be used, the nozzle tip 100 may be moved towards its closed outlet area position (decreasing the outlet area) in order to increase the exit velocity of the pulverized coal to ensure optimal combustion.

Figure 17:
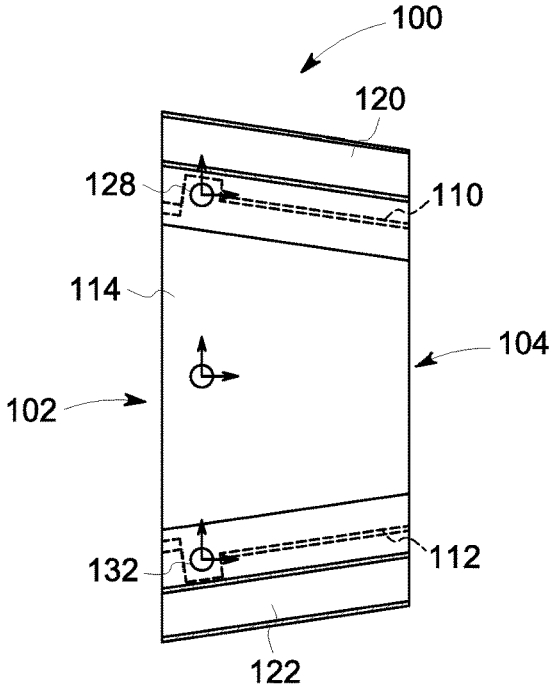
FIG. 17 is a side, cross-sectional view of the solid fuel nozzle tip of FIG. 2, illustrating a neutral and non-angled position thereof.
Figure 18:
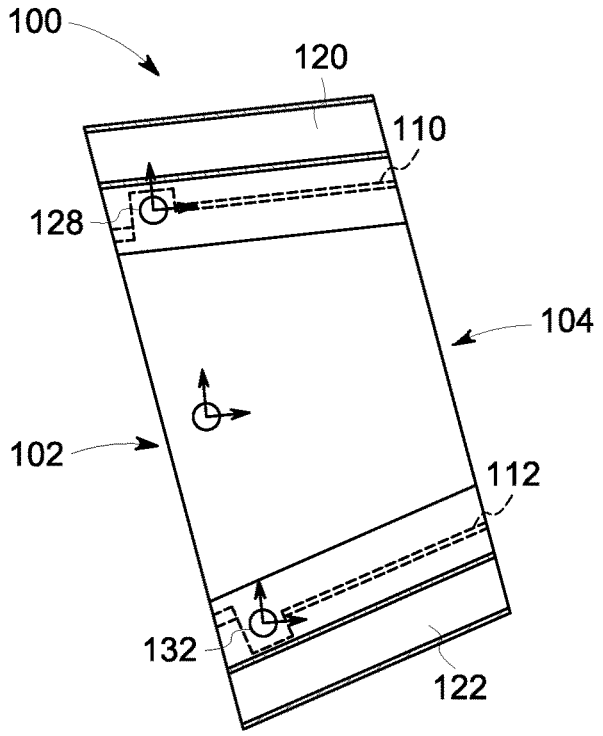
FIG. 18 is a side, cross-sectional view of the solid fuel nozzle tip of FIG. 2, illustrating a neutral and upwardly angled position thereof.
Figure 19:
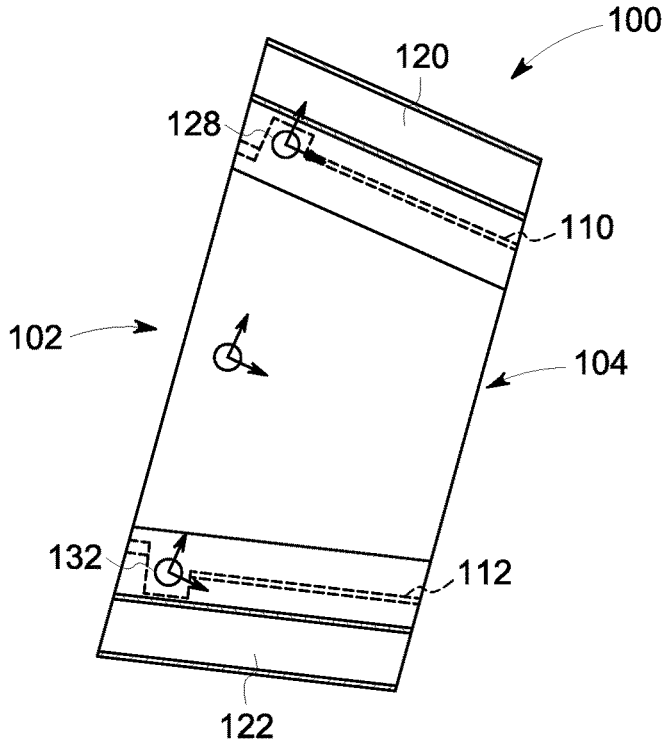
FIG. 19 is a side, cross-sectional view of the solid fuel nozzle tip of FIG. 2, illustrating a neutral and downwardly-angled position thereof.
Figure 20:
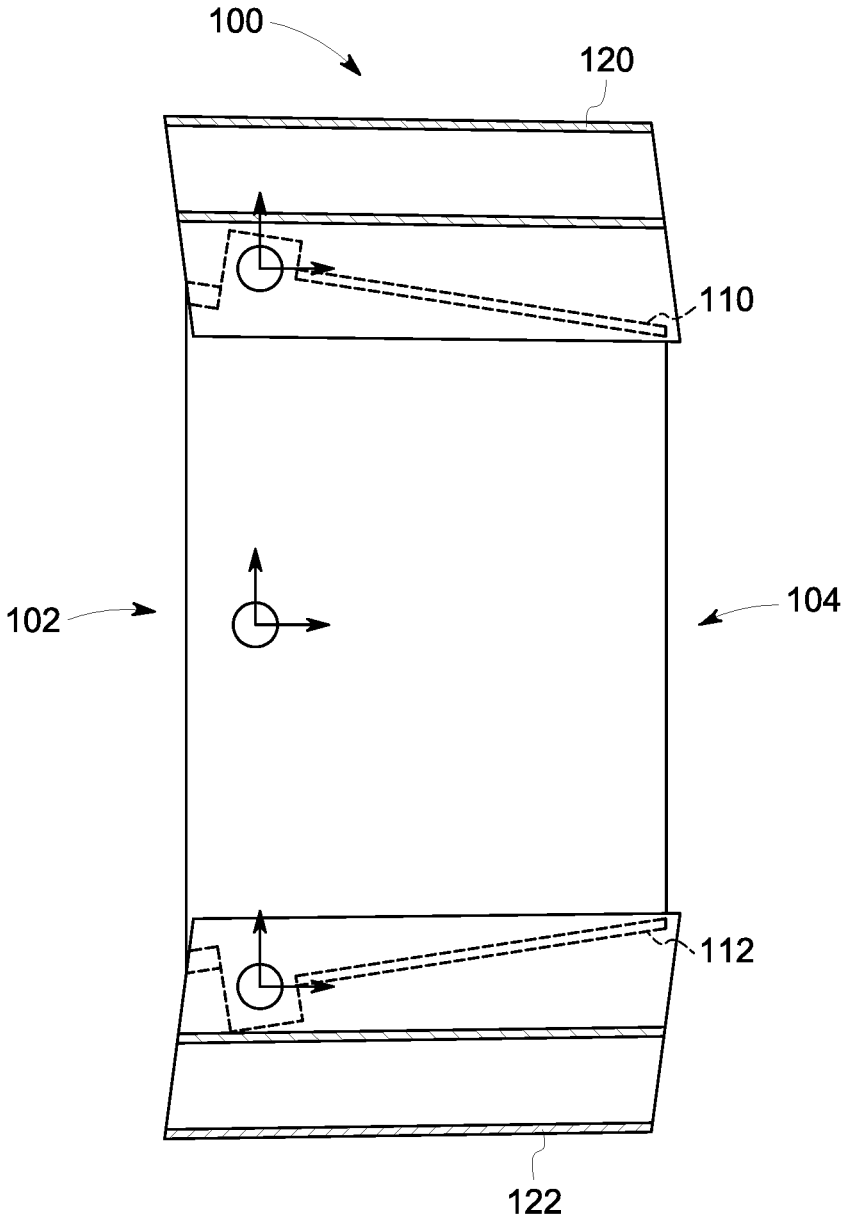
FIG. 20 is a side, cross-sectional view of the solid fuel nozzle tip of FIG. 2, illustrating an open and non-angled position thereof.
Figure 21:
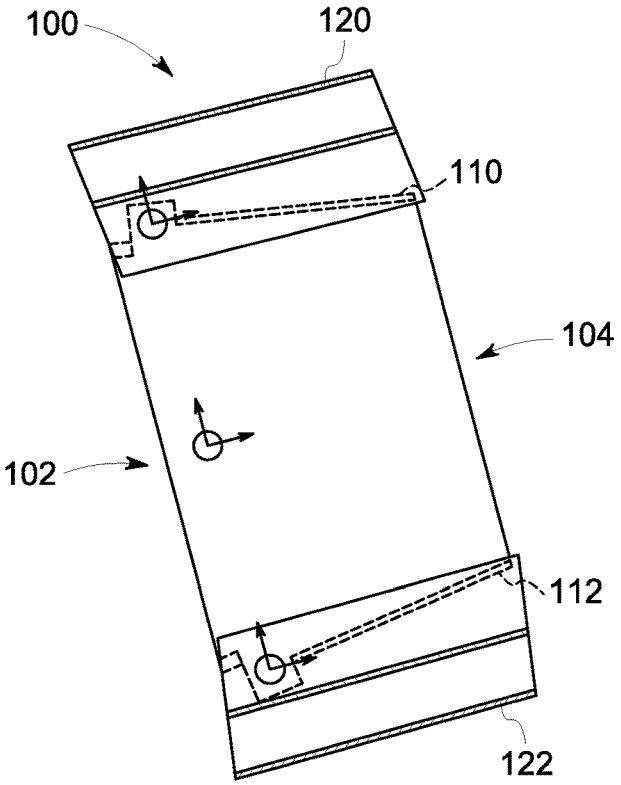
FIG. 21 is a side, cross-sectional view of the solid fuel nozzle tip of FIG. 2, illustrating an open and upwardly-angled position thereof.
Figure 22:
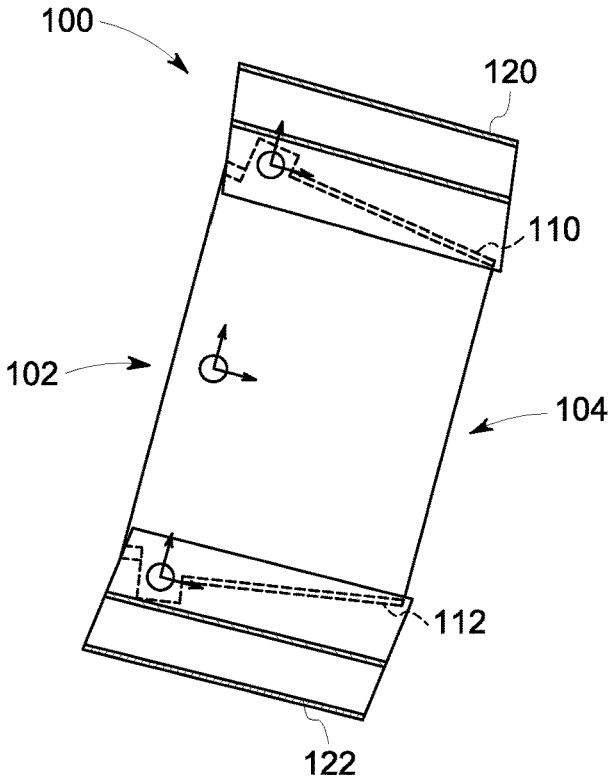
FIG. 22 is a side, cross-sectional view of the solid fuel nozzle tip of FIG. 2, illustrating an open and downwardly-angled position thereof.
Figure 23:
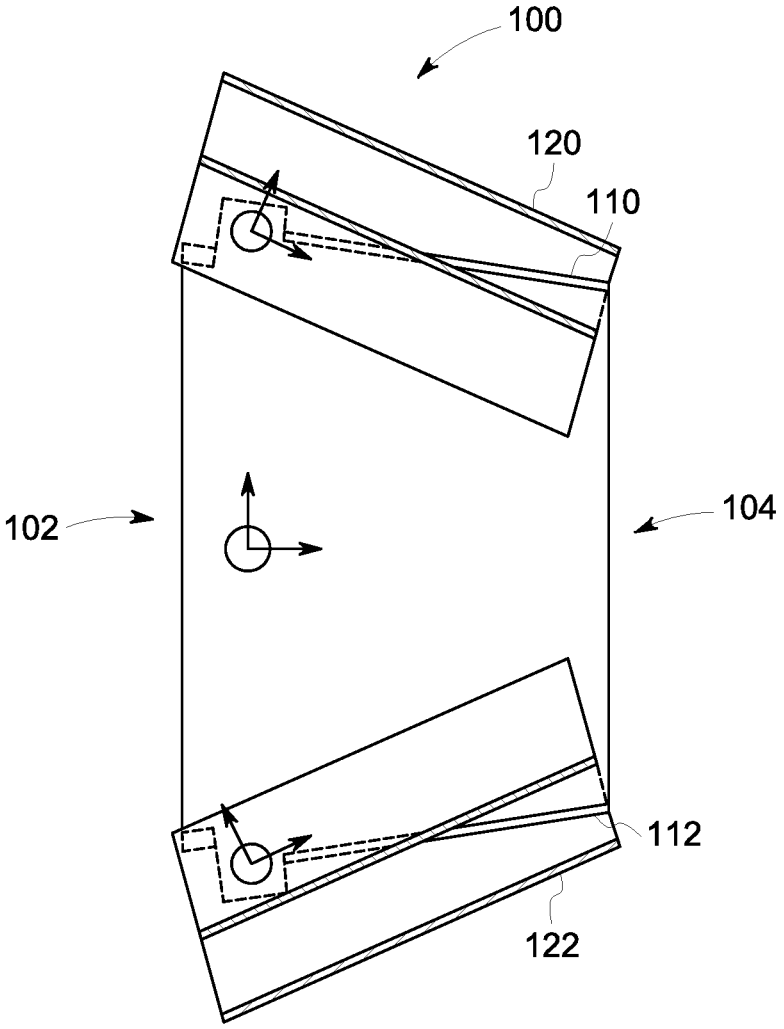
FIG. 23 is a side, cross-sectional view of the solid fuel nozzle tip of FIG. 2, illustrating a closed and non-angled position thereof.
Figure 24:
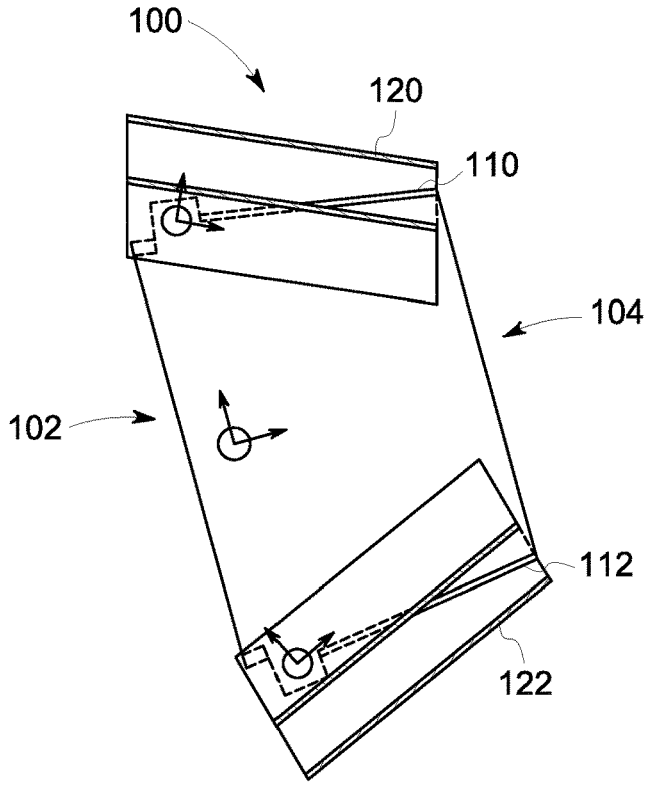
FIG. 24 is a side, cross-sectional view of the solid fuel nozzle tip of FIG. 2, illustrating a closed and upwardly-angled position thereof.
Figure 25:
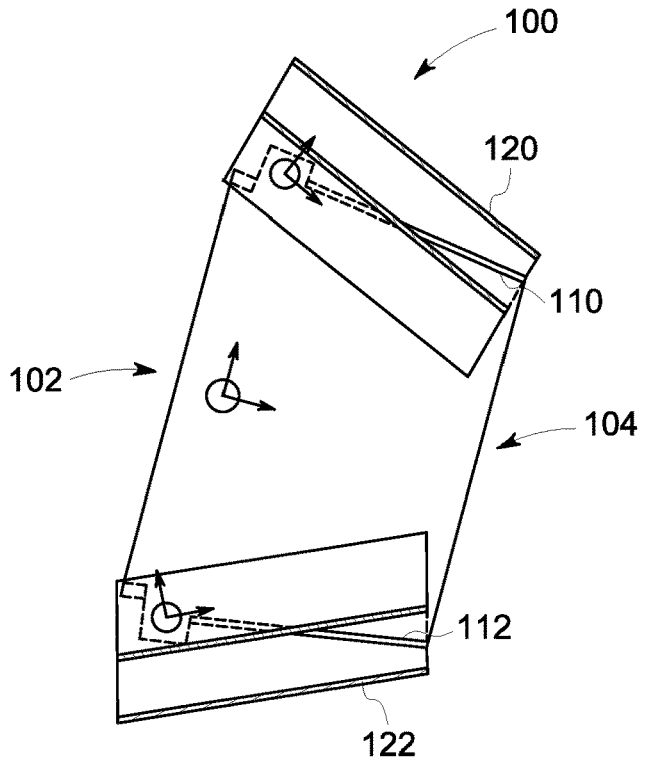
FIG. 25 is a side, cross-sectional view of the solid fuel nozzle tip of FIG. 2, illustrating a closed and downwardly-angled position thereof.

Referring now to FIGS. 17-25, in addition to providing the ability to adjust the outlet area to allow for the exit velocity of the solid fuel to be varied, the nozzle tip 100 of the invention is configured so as to allow for angular adjustment of the nozzle tip 100. In particular, in an embodiment, the nozzle tip 100 can be adjusted in the vertical direction (angled up or down) and/or in the horizontal direction (left and right), in any outlet position (i.e., neutral, open or closed). This angular adjustment may be carried out using any means or mechanisms known in the art. For example, FIGS. 17-19 show, for a neutral/default outlet area position, the nozzle tip 100 in a non-tilted/non-angled position, an upwardly-angled position, and a downwardly-angled position, respectively. Similarly, FIGS. 20-22 show, for an open (larger) outlet area position, the nozzle tip 100 in a non-tilted/non-angled position, an upwardly-angled position, and a downwardly-angled position, respectively. FIGS. 23-25 show, for a closed (smaller) outlet area position, the nozzle tip 100 in a non-tilted/non-angled position, an upwardly-angled position, and a downwardly-angled position, respectively.

In an embodiment, adjustment of the size of the outlet area (to vary exit velocity of the solid fuel through duct 118) as well as the angular orientation of the nozzle tip (to change the direction of solid fuel injection into the furnace 10) can be carried out under control of a controller (not shown). For example, in an embodiment, a user may input into the controller (via a suitable interface) a rank of coal used, volatile matter content of the coal used, etc., and the controller may automatically adjust the outlet area and/or angular orientation of the nozzle tip 100 to achieve optimal combustion results for the particular coal rank/type utilized. In yet other embodiments, the controller may adjust then size of the outlet area and/or angular orientation of the nozzle tip 100 in real-time or near real-time based on measured or sensed operational parameters of the burner 10 (e.g., temperature, emission levels, etc.).

Figure 26:
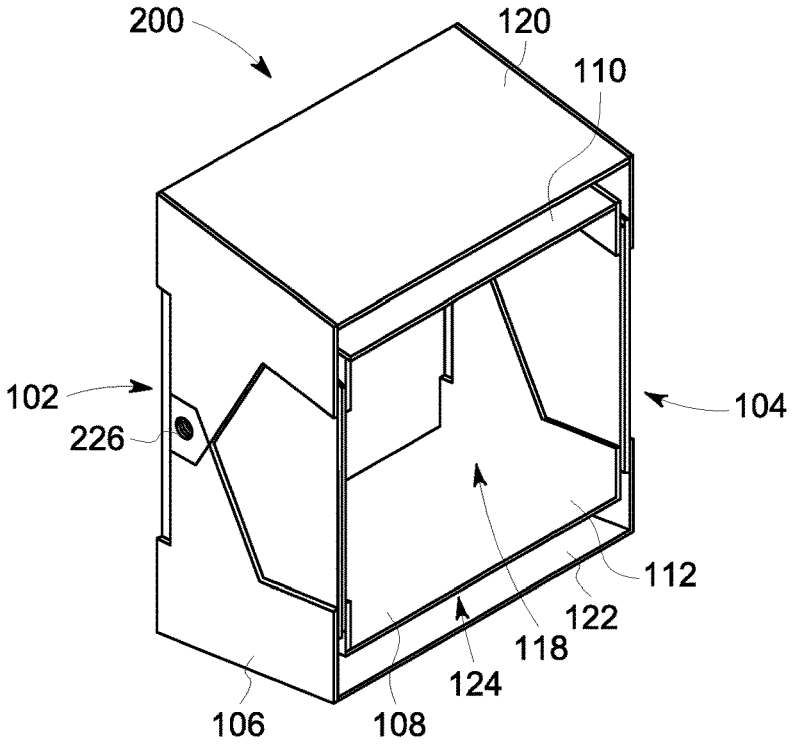
FIG. 26 is an outlet end, perspective view of a solid fuel nozzle tip for use with the pulverized solid fuel-fired furnace of FIG. 1, according to another embodiment of the invention, showing a neutral outlet area position thereof.

Referring now to FIG. 26, a nozzle tip 200 according to another embodiment of the invention is illustrated. As shown therein, the nozzle tip 200 is substantially similar in configuration to nozzle tip 100, where like reference numerals indicate like parts. As shown therein, however the configuration of the top and bottom plates is slightly different, and the respective top and bottom plates 110, 120, 112, 122 of the primary shroud 108 and secondary shroud 108 are rotatable about a common, singular axis extending through pivot point 226. As with the nozzle tip 100 described above, nozzle tip 200 of FIG. 26 may be selectively adjusted to vary the cross-sectional outlet area at the outlet end 104 of the nozzle tip 200.

Figure 27:
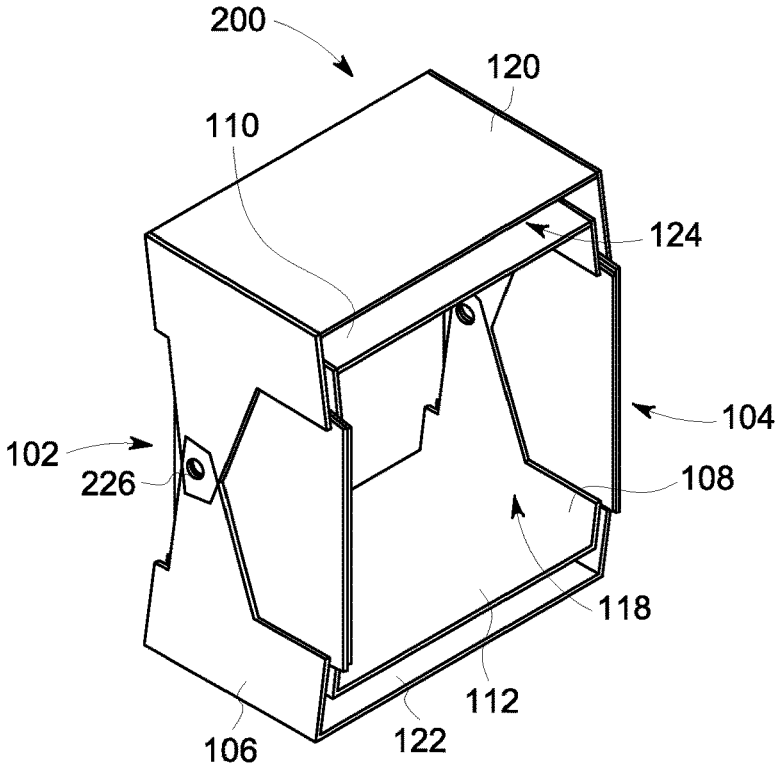
FIG. 27 is an outlet end, perspective view of the solid fuel nozzle tip of FIG. 26, showing an open outlet area position thereof.
Figure 28:
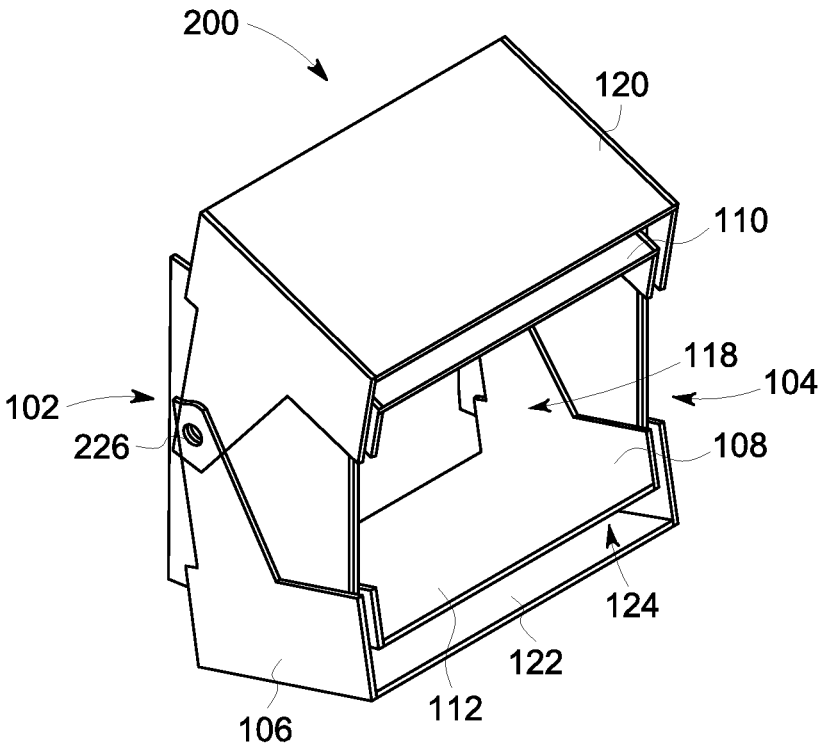
FIG. 28 is an outlet end, perspective view of the solid fuel nozzle tip of FIG. 26, showing a closed outlet area position thereof.

In particular, FIG. 26 illustrates the nozzle tip 200 in a neutral position, an having a first outlet area. FIG. 27 illustrates the nozzle tip 200 in an open position, having a second outlet area that is greater than the first outlet area (which effectively decreases the exit velocity of solid fuel as it exits the nozzle tip 200). FIG. 28 illustrates the nozzle tip 200 in a closed position, having a third outlet area that is less than the first outlet area (which effectively increases the exit velocity of solid fuel as it exits the nozzle tip 200).

Figure 29:
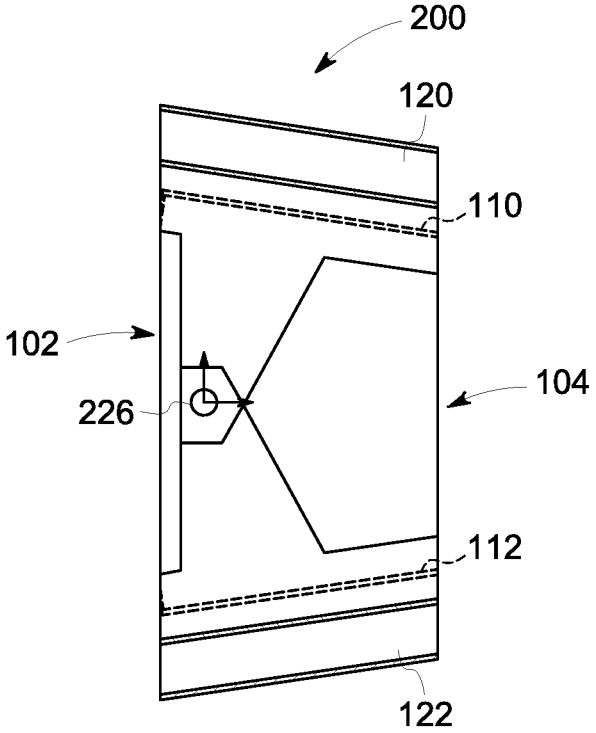
FIG. 29 is a side, cross-sectional view of the solid fuel nozzle tip of FIG. 26, illustrating a neutral and non-angled position thereof.
Figure 30:
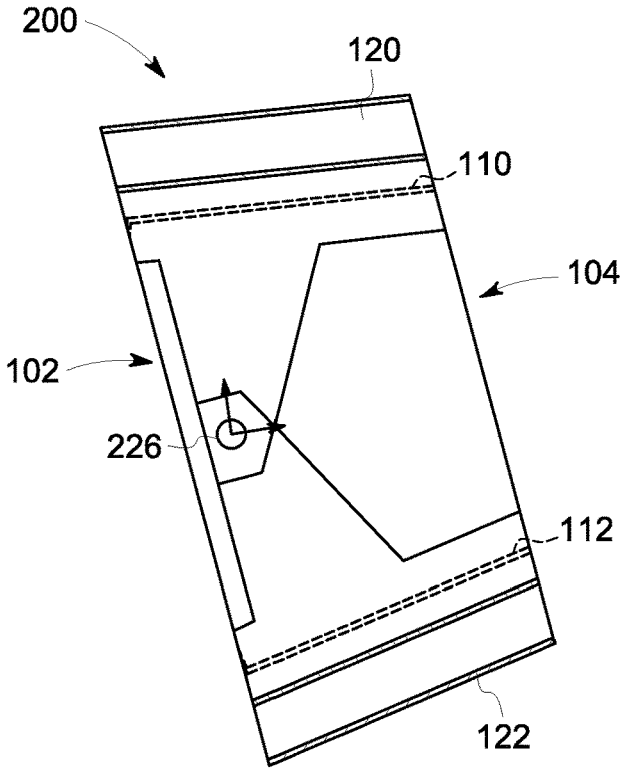
FIG. 30 is a side, cross-sectional view of the solid fuel nozzle tip of FIG. 26, illustrating a neutral and upwardly-angled position thereof.
Figure 31:
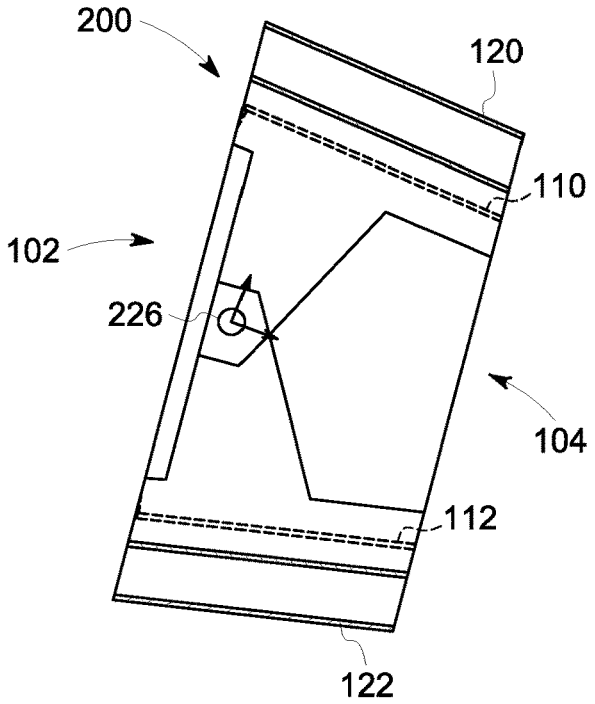
FIG. 31 is a side, cross-sectional view of the solid fuel nozzle tip of FIG. 26, illustrating a neutral and downwardly-angled position thereof.
Figure 32:
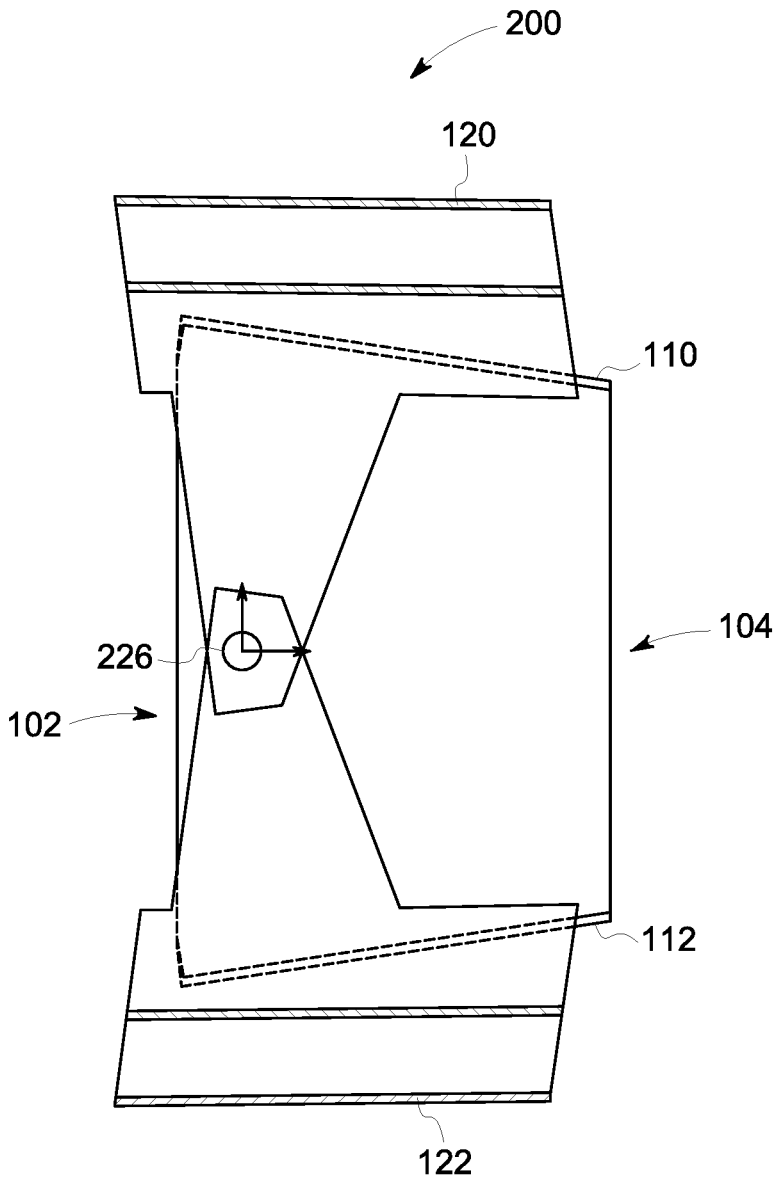
FIG. 32 is a side, cross-sectional view of the solid fuel nozzle tip of FIG. 26, illustrating an open and non-angled position thereof.
Figure 33:
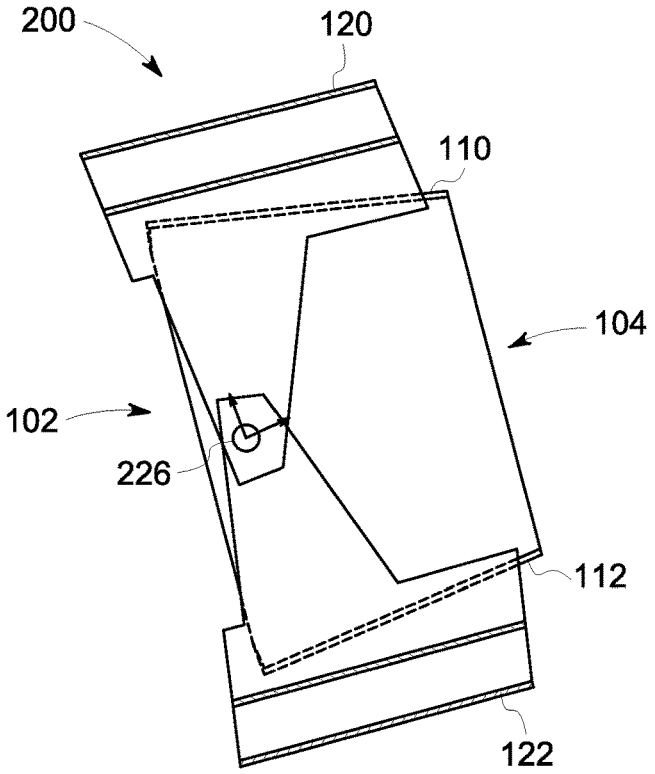
FIG. 33 is a side, cross-sectional view of the solid fuel nozzle tip of FIG. 26, illustrating an open and upwardly-angled position thereof.
Figure 34:
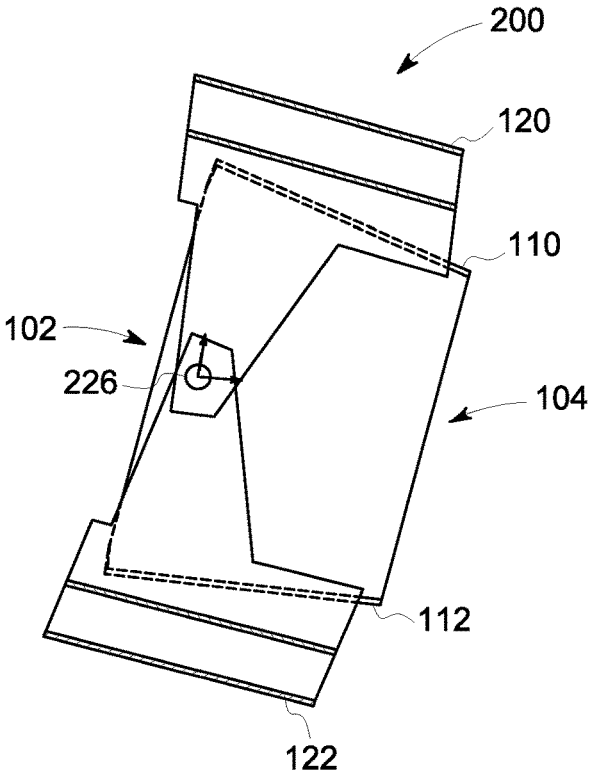
FIG. 34 is a side, cross-sectional view of the solid fuel nozzle tip of FIG. 26, illustrating an open and downwardly-angled position thereof.
Figure 35:
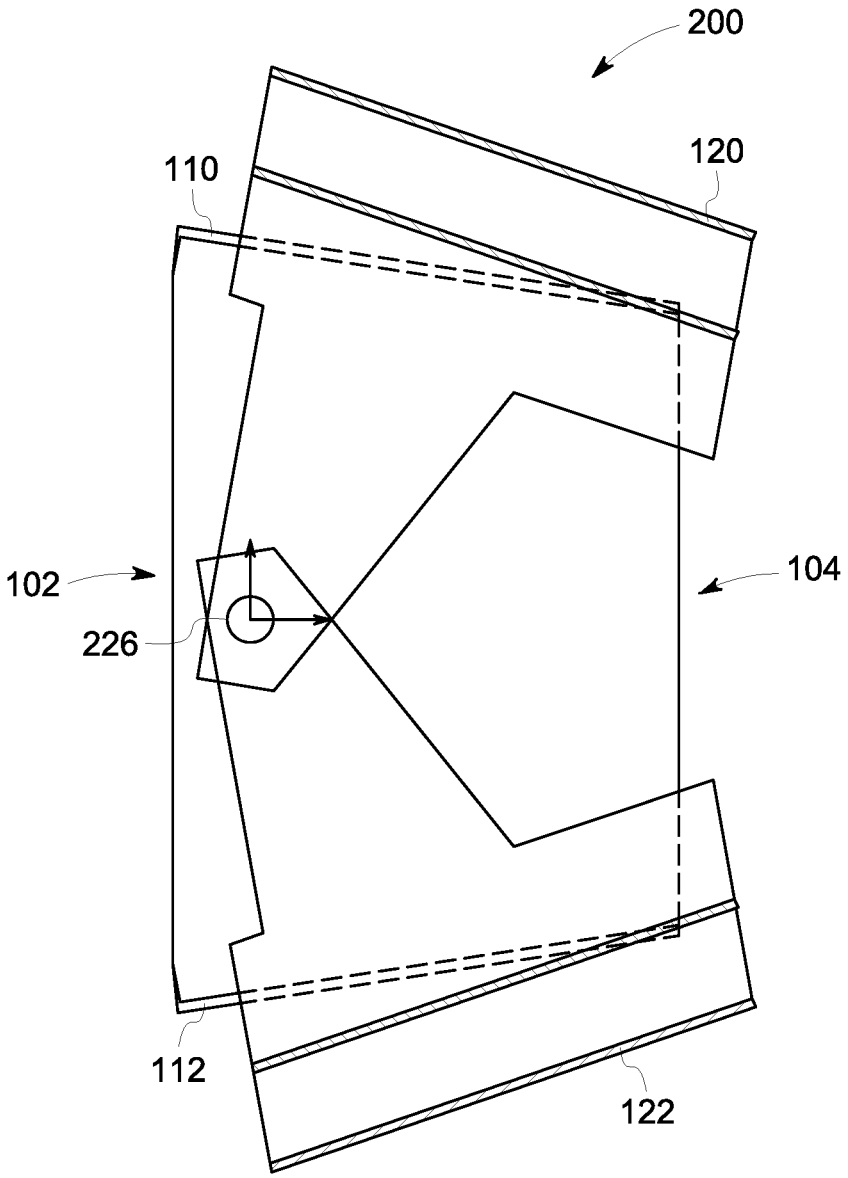
FIG. 35 is a side, cross-sectional view of the solid fuel nozzle tip of FIG. 26, illustrating a closed and non-angled position thereof.
Figure 36:
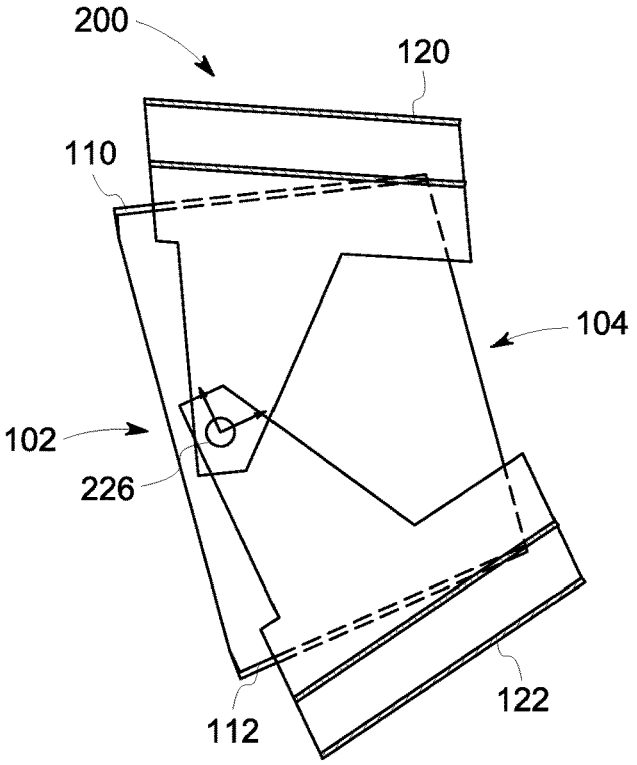
FIG. 36 is a side, cross-sectional view of the solid fuel nozzle tip of FIG. 26, illustrating a closed and upwardly-angled position thereof.
Figure 37:
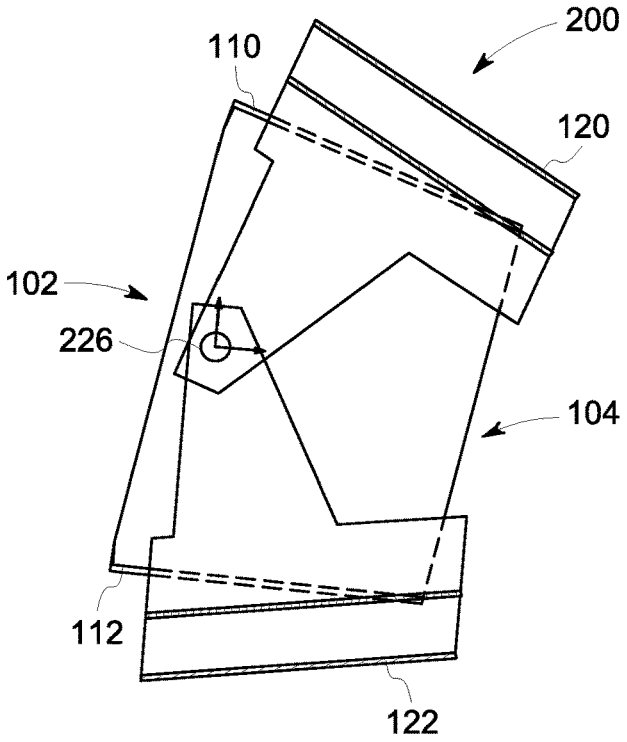
FIG. 37 is a side, cross-sectional view of the solid fuel nozzle tip of FIG. 26, illustrating a closed and downwardly-angled position thereof.

Turning now to FIGS. 29-37, like nozzle tip 100, in addition to providing the ability to adjust the outlet area to allow for the exit velocity of the solid fuel to be varied, the nozzle tip 200 is similarly configured so as to allow for angular adjustment of the nozzle tip 200. In particular, in an embodiment, the nozzle tip 200 can be adjusted in the vertical direction (angled up or down) and/or in the horizontal direction (left and right), in any outlet position (i.e., neutral, open or closed). This angular adjustment may be carried out using any means or mechanisms known in the art. For example, FIGS. 29-31 show, for a neutral/default outlet area position, the nozzle tip 200 in a non-tilted/non-angled position, an upwardly-angled position, and a downwardly-angled position, respectively. Similarly, FIGS. 32-34 show, for an open (larger) outlet area position, the nozzle tip 200 in a non-tilted/non-angled position, an upwardly-angled position, and a downwardly-angled position, respectively. FIGS. 35-37 show, for a closed (smaller) outlet area position, the nozzle tip 200 in a non-tilted/non-angled position, an upwardly-angled position, and a downwardly-angled position, respectively.

As indicated above, embodiments of the invention provide a pulverized fuel furnace/burner 10 employing a nozzle with a nozzle tip 100, a cross-sectional outlet area of which is variable or adjustable. The adjustability of the outlet area provides the burner with the capability to increase or decrease the exit velocity of the pulverized coal as a function of the type of coal in use to attain optimal combustion results (i.e., high fuel conversion efficiency and ultra-low NOx emission). This is in contrast to existing pulverized coal burners that are designed to operate with a fixed nozzle tip cross-sectional area, in which the exit velocity of the pulverized coal is fixed. Accordingly, the nozzle tip of the invention allows for different coal ranks (including coal rank that is different than a design coal) to be burned to achieve optimal combustion results, avoid flame lift-off and backfire while ensuring stable and secure flame, achieve an optimal fuel conversion rate, and achieve lower principal primary emission levels (NOx and CO), all without requiring retrofitting of the nozzle, nozzle tip or other burner components. In turn, the invention described herein enables a single burner to service a wide range of coal types or ranks with a wide range of volatile matter contents to achieve optimal combustion results, simply by selectively adjusting the cross-sectional area of the pulverized coal nozzle tip to set the exit velocity at the right point. In this respect, the nozzle tip 100 may be employed in any burner in the art to provide a flexible-fuel burner.

It is further contemplated that the nozzle tip cross-sectional area can likewise be varied in dependence upon boiler load. For example, at low/partial load operation, the outlet area may be increased to decrease the exit velocity of the pulverized solid fuel in order to maintain optimal combustion at such low load conditions. At high/full load operation, the outlet area may be decreased to increase the exit velocity of the pulverized solid fuel in order to meet demand and maintain optimal combustion at such high load conditions. In an embodiment, the primary shroud and secondary shroud may be individually adjustable (without respect to the other), in which case the primary shroud and the secondary shroud may not be mechanically coupled.

In an embodiment, a nozzle tip for a pulverized solid fuel pipe nozzle of a pulverized solid fuel-fired furnace is provided. The nozzle tip includes a primary shroud having an inlet end and an outlet end, and an outlet at the outlet end for the passage of a pulverized solid fuel into the furnace. An area of the outlet is selectively adjustable to vary an exit velocity of the pulverized solid fuel from the nozzle tip. In an embodiment, a position of at least a portion of the primary shroud is movable so as to reduce the area of the outlet and increase the exit velocity of the pulverized solid fuel. In an embodiment, a position of at least a portion of the primary is movable so as to increase the area of the outlet the decrease the exit velocity of the pulverized solid fuel. In an embodiment, the primary shroud includes a top plate and a bottom plate, and opposed lateral sides at least partially defining the outlet, wherein at least one of the top plate and/or the bottom plate is adjustable to selectively increase or decrease the area of the outlet. In an embodiment, both the top plate and bottom plate are adjustable. In an embodiment, the nozzle tip includes a secondary shroud surrounding the primary shroud and a passage intermediate the primary shroud and the secondary shroud for the passage of air. In an embodiment, the primary shroud and secondary shroud are mechanically interconnected. In an embodiment, an angle of orientation of the nozzle tip with respect to the furnace is adjustable in a horizontal direction. In an embodiment, an angle of orientation of the nozzle tip with respect to the furnace is adjustable in a vertical direction. In an embodiment, the pulverized solid fuel is pulverized coal.

In another embodiment, a method of operating a burner is provided. The method includes the steps of suppling a flow of fuel through at least one fuel nozzle assembly having a nozzle tip to a combustion chamber, and varying an exit velocity of the fuel from the nozzle tip in dependence upon at least one of a property of the fuel and/or an operational requirement of the burner. In an embodiment, varying the exit velocity of the fuel includes adjusting an area of an outlet of the nozzle tip. In an embodiment, the fuel is pulverized coal and the at least one property of the fuel is a volatile matter content of the pulverized coal. In an embodiment, the method may also include the step of reducing the outlet area to increase the exit velocity where the fuel is a high rank coal. In an embodiment, the method may include the step of increasing the outlet area to decrease the exit velocity where the fuel is a high rank coal. In an embodiment, the method includes the step of adjusting an angle of orientation of the nozzle tip in a horizontal direction. In an embodiment, the method further includes the step of adjusting an angle of orientation of the nozzle tip in a vertical direction.

In yet another embodiment, a combustion system is provided. The combustion system includes a combustion chamber, and a nozzle tip of a nozzle assembly configured to direct a mixed flow of fuel and primary air into the combustion chamber, the nozzle tip including a primary shroud having an outlet. An area of the outlet is selectively adjustable to vary an exit velocity of the mixed flow of fuel and primary air from the nozzle tip. In an embodiment, a position of at least a portion of the primary shroud is movable so as to reduce the area of the outlet and increase the exit velocity of the mixed flow of fuel and primary air. In an embodiment, a position of at least a portion of the primary is movable so as to increase the area of the outlet the decrease the exit velocity of the mixed flow of fuel and primary air.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

This written description uses examples to disclose several embodiments of the invention, including the best mode, and also to enable one of ordinary skill in the art to practice the embodiments of invention, including making and using any devices or systems and performing any incorporated methods. The patentable scope of the invention is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. A nozzle tip for a pulverized solid fuel pipe nozzle of a pulverized solid fuel-fired furnace, the nozzle tip comprising:

a primary shroud having an inlet end and an outlet end, and an outlet at the outlet end for the passage of a pulverized solid fuel into the furnace;

a secondary shroud surrounding the primary shroud; and a passage intermediate the primary shroud and the secondary shroud for the passage of air;

wherein an area of the outlet is selectively adjustable to vary an exit velocity of the pulverized solid fuel from the nozzle tip; and wherein the primary shroud and the secondary shroud are mechanically interconnected such that adjustment of a position of the primary shroud results in a simultaneous adjustment of a position of the secondary shroud.

2. The nozzle tip of claim 1, wherein:

a position of at least a portion of the primary shroud is movable so as to reduce the area of the outlet and increase the exit velocity of the pulverized solid fuel.

3. The nozzle tip of claim 1, wherein:

a position of at least a portion of the primary is movable so as to increase the area of the outlet and decrease the exit velocity of the pulverized solid fuel.

4. The nozzle tip of claim 1, wherein:

the primary shroud includes a top plate and a bottom plate, and opposed lateral sides at least partially defining the outlet;

wherein at least one of the top plate and/or the bottom plate is adjustable to selectively increase or decrease the area of the outlet.

5. The nozzle tip of claim 4, wherein:

both the top plate and bottom plate are adjustable.

6. The nozzle tip of claim 1, wherein:

an angle of orientation of the nozzle tip with respect to the furnace is adjustable in a horizontal direction.

7. The nozzle of claim 1, wherein:

an angle of orientation of the nozzle tip with respect to the furnace is adjustable in a vertical direction.

8. The nozzle of claim 1, wherein:

the pulverized solid fuel is pulverized coal.

9. A method of operating a burner, comprising the steps of:

suppling a flow of fuel through at least one fuel nozzle assembly having a nozzle tip to a combustion chamber, the nozzle tip having a primary shroud for passage of the flow of fuel therethrough, and a secondary shroud surrounding the primary shroud, the primary shroud and the secondary shroud being mechanically interconnected and defining therebetween a passage for the passage of air;

varying an exit velocity of the fuel from the nozzle tip in dependence upon at least one of a property of the fuel and/or an operational requirement of the burner; and adjusting a position of the primary shroud;

wherein adjustment of the position of the primary shroud causes a simultaneous adjustment of a position of the secondary shroud as a result of the mechanical interconnection between the primary shroud and the secondary shroud.

10. The method according to claim 9, wherein:

varying the exit velocity of the fuel includes adjusting an area of an outlet of the nozzle tip.

11. The method according to claim 10, wherein:

the fuel is pulverized coal; and the at least one property of the fuel is a volatile matter content of the pulverized coal.

12. The method according to claim 11, further comprising the step of:

reducing the outlet area to increase the exit velocity where the fuel is a high rank coal.

13. The method according to claim 11, further comprising the step of:

increasing the outlet area to decrease the exit velocity where the fuel is a high rank coal.

14. The method according to claim 9, further comprising the step of:

adjusting an angle of orientation of the nozzle tip in a horizontal direction.

15. The method according to claim 9, further comprising the step of:

adjusting an angle of orientation of the nozzle tip in a vertical direction.

* * * * *